US008465117B2

(12) United States Patent
Sato et al.

(10) Patent No.: US 8,465,117 B2
(45) Date of Patent: Jun. 18, 2013

(54) FLUID EJECTING APPARATUS AND FLUID EJECTING METHOD

(75) Inventors: Akito Sato, Matsumoto (JP); Tomohiro Yuda, Minowa-machi (JP); Takahide Miyashita, Shiojiri (JP); Naoki Sudo, Matsumoto (JP); Mai Kubota, Shiojiri (JP); Bunji Ishimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 212 days.

(21) Appl. No.: 13/009,150

(22) Filed: Jan. 19, 2011

(65) Prior Publication Data

US 2011/0175958 A1 Jul. 21, 2011

(30) Foreign Application Priority Data

Jan. 19, 2010 (JP) ..... 2010-009398

(51) Int. Cl.
*B41J 25/308* (2006.01)
*B41J 29/38* (2006.01)

(52) U.S. Cl.
USPC ..... 347/14; 347/8

(58) Field of Classification Search
USPC ..... 347/14, 8
See application file for complete search history.

(56) References Cited

U.S. PATENT DOCUMENTS 6,471,315 B1 10/2002 Kurata
2005/0052487 A1* 3/2005 Yamasaki ..... 347/19

FOREIGN PATENT DOCUMENTS

EP 0925928 A2 6/1999
JP 11240146 A 9/1999

* cited by examiner

*Primary Examiner* — Uyen Chau N Le
*Assistant Examiner* — Kajli Prince
(74) *Attorney, Agent, or Firm* — Nutter McClennen & Fish LLP; John J. Penny, V

(57) ABSTRACT

A fluid ejecting apparatus includes a head that is provided with a first-nozzle-row and a second-nozzle-row, a platen that is provided with a plurality of convex-portions, and a control unit repeats an operation of ejecting fluid from the nozzles moving in two directions of a forward-path and a backward-path. The control unit adjusts the ejecting time such that, at the medium of the convex-portions, an amount-of-deviation in the movement-direction of the dots formed on the forward-path and the backward-path by the first-nozzle-row is less than an amount-of-deviation of the dots formed on the forward-path and backward-path by the second-nozzle-row. In the ejection operation, and such that the position in the movement-direction of the dots formed by the second-nozzle-row is a position opposite to the side on which the head moves in the movement-direction with respect to the position in the movement-direction of the dots formed by the first-nozzle-row.

11 Claims, 14 Drawing Sheets

FIG. 14

| | | EQUAL TO OR MORE THAN 50% AND LESS THAN 80% | | EQUAL TO OR MORE THAN 80% | |
|---|---|---|---|---|---|
| | | FORWARD PATH | BACKWARD PATH | FORWARD PATH | BACKWARD PATH |
| MEDIUM 1 | K1 | R1t | R1b | R1t | R1b |
| | K2 | R2t | R2b | R2t | R2b |
| MEDIUM 2 | K1 | R1t | R1b | R1t | R1b |
| | K2 | R2t | R2b | R2t | R2b |
| MEDIUM 3 | K1 | R1t | R1b | R1t | R1b |
| | K2 | R2t | R2b | R2t | R2b |

FLUID EJECTING APPARATUS AND FLUID EJECTING METHOD

BACKGROUND

1. Technical Field

The present invention relates to a fluid ejecting apparatus and a fluid ejecting method.

2. Related Art

An ink jet printer (hereinafter, referred to as a printer) that ejects ink (fluid) from a head (nozzles) while moving the head in a movement direction to form an image has been known as one of fluid ejecting devices. In the printer, the timing for ejecting the ink from the nozzles is set to form dots at a target position on a medium.

However, when the solvent component (e.g., water) of the ink infiltrates the medium, a phenomenon of undulations in the medium (cockling phenomenon) occurs. Since the distance from the nozzles to the medium fluctuates, dots are formed deviating from the target position when ink is ejected from the nozzles at the set timing.

Thus, a printer that corrects the timing for ejecting ink from the nozzles according to the distance between the medium with the cockling phenomenon and the nozzles is proposed.

JP-A-11-240146 is an example of the related art.

Since a medium with the cockling phenomenon has a ridge portion and a valley portion, the distance between the medium and the nozzles is different according to the position of the medium. For example, it is assumed that the timing for ejecting the ink from the nozzles is corrected according to the distance from the nozzles to the ridge portion of the medium such that the position where a target dot is formed and the actual position a dot is formed coincide with each other. Then, in the valley portion of the medium, the difference between the target dot formation position and the actual dot formation position becomes larger. Particularly, in a printer in which the head moves in two movement directions, the difference of forward and backward dot formation positions becomes larger in the valley portion of the medium.

SUMMARY

An advantage of some aspects of the invention is to reduce deterioration in image quality caused by the misalignment of forward and backward dot formation positions.

According to an advantage of the invention, there is provided a fluid ejecting apparatus including: a head that is provided with a first nozzle row in which nozzles ejecting fluid are arranged in a predetermined direction, and a second nozzle row in which nozzles ejecting the fluid are arranged in the predetermined direction, the first nozzle row and the second nozzle row being arranged in a movement direction crossing the predetermined direction; a platen that supports a medium opposed to the head and is provided with a plurality of convex portions arranged in the movement direction on the side opposed to the medium; and a control unit that repeatedly performs an ejection operation of ejecting fluid from the nozzles moving in two directions of a forward path and a backward path while moving the head forward and backward and an operation of relatively moving relative positions of the head and the medium in one direction of the predetermined direction. The control unit performs an adjustment process of adjusting the ejection time of the fluid from the first nozzle row and the second nozzle row such that, at parts of the medium corresponding to the convex portions, an amount of deviation in the movement direction of the dots formed on the forward path by the first nozzle row and the dots formed on the backward path by the first nozzle row is less than the amount of deviation in the movement direction of the dots formed on the forward path by the second nozzle row and the dots formed on the backward path by the second nozzle row, and such that, in the ejection operation, the position in the movement direction of the dots formed by the second nozzle row is a position opposite to the side on which the head moves in the movement direction with respect to the position in the movement direction of the dots formed by the first nozzle row.

Other aspects of the invention will be clearly described in the specification and accompanying drawings.

BRIEF DESCRIPTION OF THE DRAWINGS

The invention will be described with reference to the accompanying drawings, wherein like numbers reference like elements.

FIG. 14 is a diagram illustrating a table in which cockling adjustment values according to the kinds of media are stored.

DESCRIPTION OF EXEMPLARY EMBODIMENTS

Outline of Disclosure

Figure 1A:
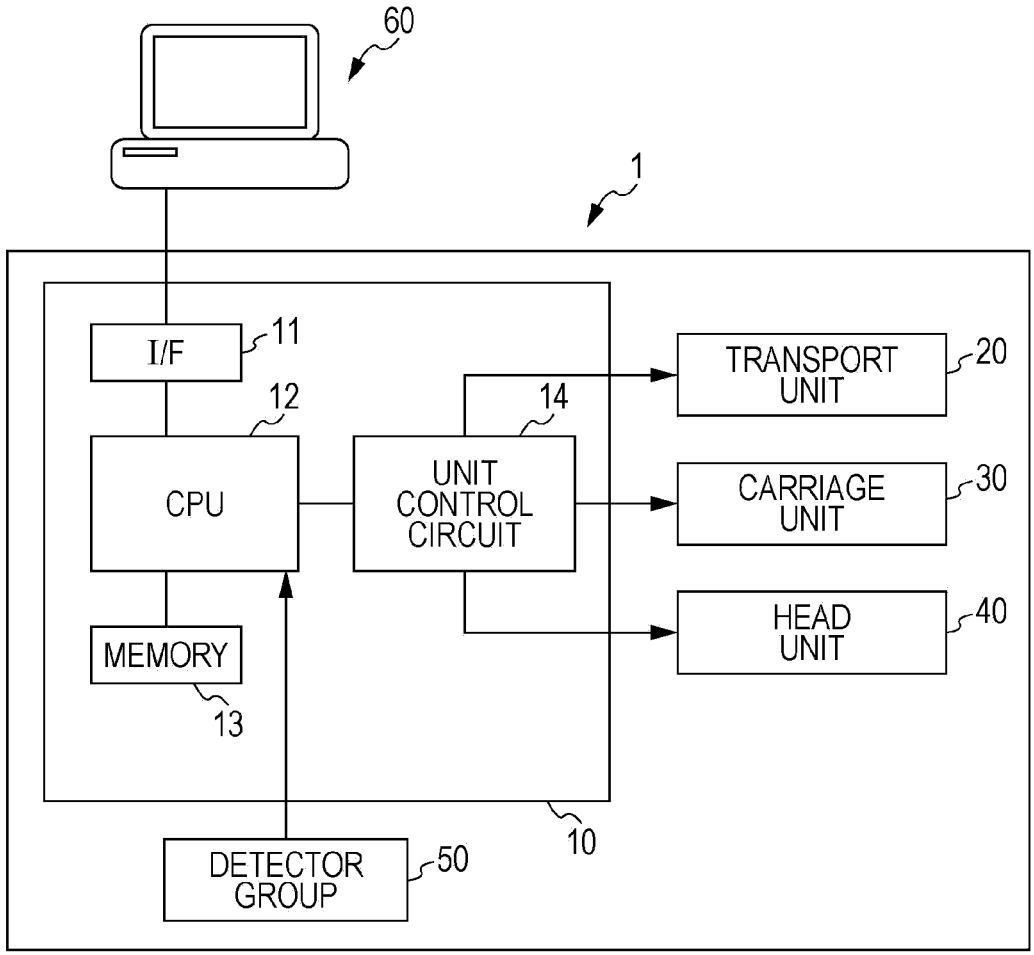
FIG. 1A is a block diagram illustrating an overall configuration of a printing system.

The following will be clarified by description of the specification and description of the accompanying drawings.

A fluid ejecting apparatus includes: a head that is provided with a first nozzle row in which nozzles ejecting fluid are arranged in a predetermined direction, and a second nozzle row in which nozzles ejecting the fluid are arranged in the predetermined direction, the first nozzle row and the second nozzle row being arranged in a movement direction crossing the predetermined direction; a platen that supports a medium opposed to the head and is provided with a plurality of convex portions arranged in the movement direction on the side opposed to the medium; and a control unit that repeatedly performs an ejection operation of ejecting fluid from the nozzles moving in two directions of a forward path and a backward path while moving the head forward and backward and an operation of relatively moving relative positions of the head and the medium in one direction of the predetermined direction, wherein the control unit performs an adjustment process of adjusting the ejection time for the fluid from the first nozzle row and the second nozzle row such that, at parts of the medium corresponding to the convex portions, the amount of deviation in the movement direction of the dots formed on the forward path by the first nozzle row and the dots formed on the backward path by the first nozzle row is less than the amount of deviation in the movement direction of the dots formed on the forward path by the second nozzle row and the dots formed on the backward path by the second nozzle row, and such that, in the ejection operation, the position in the movement direction of the dots formed by the second nozzle row is a position opposite to the side on which the head moves in the movement direction with respect to the position in the movement direction of the dots formed by the first nozzle row.

According to the fluid ejecting apparatus, it is possible to reduce deterioration in image quality caused by misalignment of the forward and backward dot formation positions.

In the fluid ejecting apparatus, in the ejection operation, a difference between the position in the movement direction of the dots formed by the first nozzle row and the position in the movement direction of the dots formed by the second nozzle row is a half of the amount of deviation in the movement direction of the dots formed on the forward path and the backward path by the first nozzle row at the parts of the medium positioned between the convex portions arranged in the movement direction.

According to the fluid ejecting apparatus, it is possible to reduce the amount of forward and backward deviation of the dot formation positions of the second nozzle row at the parts of the medium positioned between the convex portions.

In the fluid ejecting apparatus, at parts of the medium corresponding to the convex portions, the ejection time for the fluid from the first nozzle row is adjusted such that the positions in the movement direction of the dots formed on the forward path and the backward path by the first nozzle row coincide with each other.

According to the fluid ejecting apparatus, it is possible to reduce deterioration in image quality caused by misalignment of forward and backward dot formation positions.

In the fluid ejecting apparatus, the ejection time for the fluid from the first nozzle row is an average value of the ejection time of the first nozzle row adjusted such that the amount of deviation in the movement direction of the dots formed on the forward path and the backward path by the first nozzle row is less than the amount of deviation in the movement direction of the dots formed on the forward path and the backward path by the second nozzle row, at the parts of the medium corresponding to the plurality of convex portions.

According to the fluid ejecting apparatus, it is possible to further reduce deterioration in image quality caused by misalignment of forward and backward dot formation positions with high precision.

In the fluid ejecting apparatus, the control unit performs the adjustment process when an amount of the fluid ejected onto the vicinity of a unit area on the medium is equal to or more than a threshold value.

According to the fluid ejecting apparatus, it is possible to perform an adjustment process when a cockling phenomenon occurs on the medium.

In the fluid ejecting apparatus, the control unit changes the ejection time for the fluid from the first nozzle row and the second nozzle row in the adjustment process, according to the amount of the fluid ejected onto the vicinity of the unit area on the medium.

According to the fluid ejecting apparatus, it is possible to adjust the ejection time from the nozzle rows according to the cockling state (amount of change in paper gap) of the medium.

A fluid ejecting apparatus includes: a head that is provided with a first nozzle row in which nozzles ejecting fluid are arranged in a predetermined direction, and a second nozzle row in which nozzles ejecting the fluid are arranged in the predetermined direction, the first nozzle row and the second nozzle row being arranged in a movement direction crossing the predetermined direction; a platen that supports a medium opposed to the head and is provided with a plurality of convex portions arranged in the movement direction on the side opposed to the medium; and a control unit that repeatedly performs an ejection operation of ejecting fluid from the nozzles moving in two directions of a forward path and a backward path while moving the head forward and backward and an operation of relatively moving relative positions of the head and the medium in one direction of the predetermined direction, wherein the control unit adjusts ejection time for the fluid from the first nozzle row and the second nozzle row such that, at parts of the medium corresponding to intermediate portions of the convex portions arranged in the movement direction, an amount of deviation in the movement direction of the dots formed on the forward path by the first nozzle row and the dots formed on the backward path by the first nozzle row is less than the amount of deviation in the movement direction of the dots formed on the forward path by the second nozzle row and the dots formed on the backward path by the second nozzle row, and such that, in the ejection operation, the position in the movement direction of the dots formed by the second nozzle row is a position of the side on which the head moves in the movement direction with respect to the position in the movement direction of the dots formed by the first nozzle row.

According to the fluid ejecting apparatus, it is possible to reduce deterioration in image quality caused by misalignment of forward and backward dot formation positions.

There is provided a fluid ejecting method of a fluid ejecting apparatus including: a head that is provided with a first nozzle row in which nozzles ejecting fluid are arranged in a predetermined direction, and a second nozzle row in which nozzles ejecting the fluid are arranged in the predetermined direction, the first nozzle row and the second nozzle row being arranged in a movement direction crossing the predetermined direction, and a platen that supports a medium opposed to the head and is provided with a plurality of convex portions arranged in the movement direction on the side opposed to the medium, in which an ejection operation of ejecting fluid from the nozzles moving in two directions of a forward path and a backward path while moving the head forward and backward and an operation of relatively moving relative positions of the head and the medium in one direction of the predetermined direction are repeatedly performed, wherein ejection time for the fluid from the first nozzle row and the second nozzle row is adjusted such that, at parts of the medium corresponding to the convex portions, an amount of deviation in the movement direction of the dots formed on the forward path by the first nozzle row and the dots formed on the backward path by the first nozzle row is less than the amount of deviation in the movement direction of the dots formed on the forward path by the second nozzle row and the dots formed on the backward path by the second nozzle row, and such that, in the ejection operation, the position in the movement direction of the dots formed by the second nozzle row is a position opposite to the side on which the head moves in the movement direction with respect to the position in the movement direction of the dots formed by the first nozzle row.

According to the fluid ejecting method, it is possible to reduce deterioration in image quality caused by misalignment of forward and backward dot formation positions.

Printing System

Hereinafter, an embodiment of a printing system in which a printer and a computer are connected to each other will be described by exemplifying an ink jet printer (hereinafter, referred to as a printer) as the fluid ejecting apparatus.

Figure 1B:
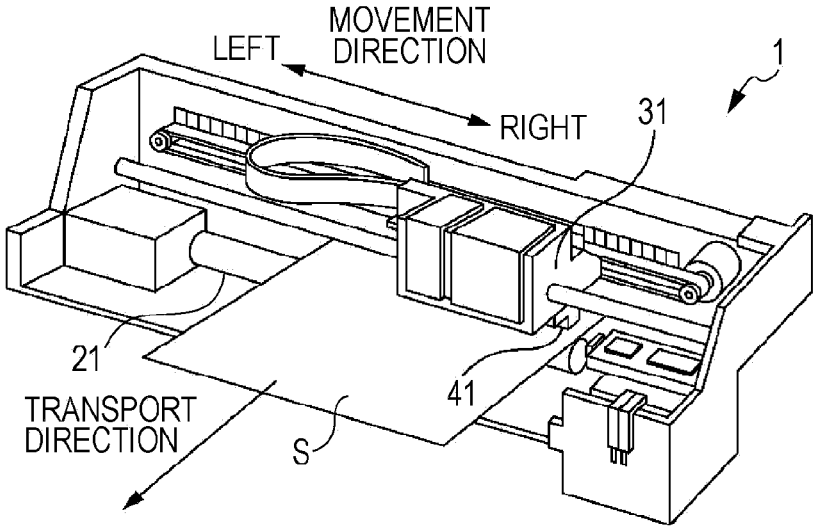
FIG. 1B is a schematic perspective view of a printer.

FIG. 1A is a block diagram illustrating an overall configuration of a printing system, and FIG. 1B is a schematic perspective view of a printer 1. The printer 1 receiving printing data from a computer 60 that is an external device controls units (a transport unit 20, a carriage unit 30, and a head unit 40) by a controller 10 to form an image on a medium S (paper, film, etc.). A detector group 50 monitors a situation in the printer 1, and the controller 10 controls the units on the basis of the detection result.

The controller 10 is a control unit for controlling the printer 1. An interface unit 11 is to transmit and receive data between the computer 60 that is the external device and the printer 1. A CPU 12 is an operation processing device for overall controlling the printer 1. A memory 13 is to secure an area for storing programs of the CPU 12 or a work area. The CPU 12 controls the units by a unit control circuit 14 according to the programs stored in the memory 13.

The transport unit 20 transports the medium S to a printable position, and transports the medium S at a predetermined transport rate in a transport direction (a predetermined direction) at the printing time.

The carriage unit 30 is to move a head 41 in a direction (a movement direction) crossing the transport direction, and has a carriage 31 and a guide shaft 32.

The head unit 40 has the head 41 for ejecting ink to the medium S. A plurality of nozzles that are ink ejecting units are provided on the lower face of the head 41, and each nozzle is provided with an ink chamber (not shown) storing ink. The method of ejecting fluid from the nozzles may be a piezoelectric method of applying voltage to a driving element (a piezoelectric element) to swell and contract a pressure chamber, thereby ejecting the fluid, and may be a thermal method of generating bubbles in the nozzles using a heat generating element to eject liquid by the bubbles.

Figure 2:
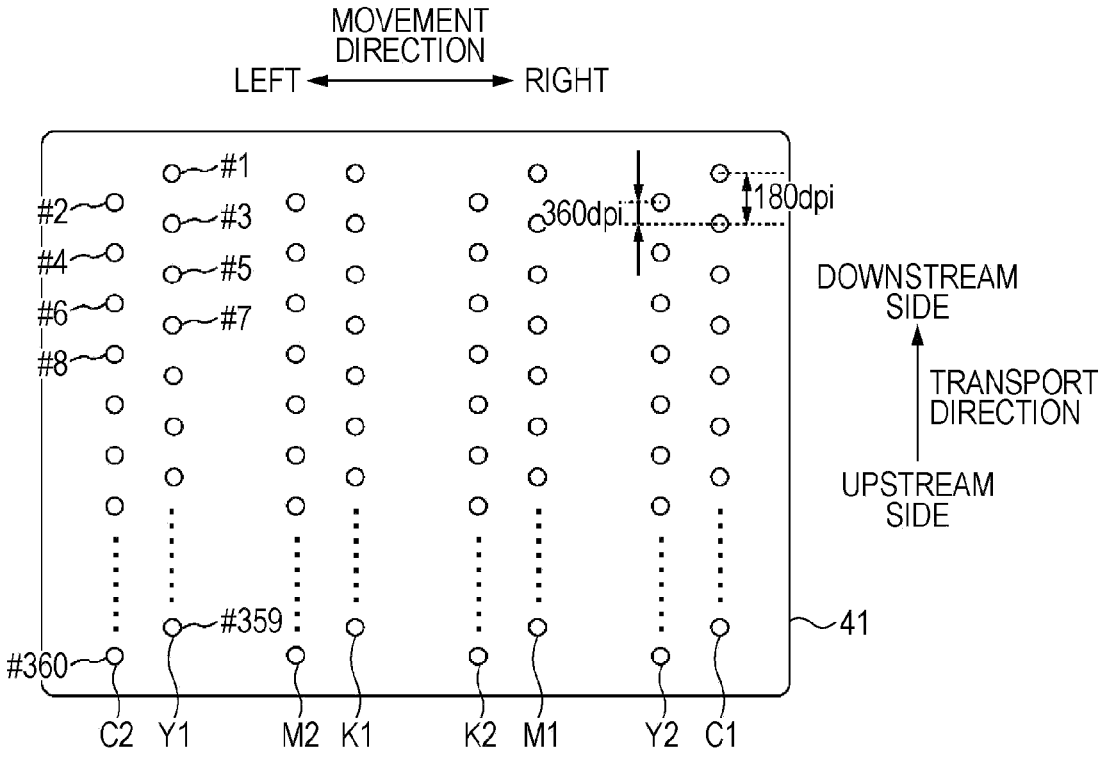
FIG. 2 is a diagram illustrating nozzle arrangement of a lower face of a head.

FIG. 2 is a diagram illustrating nozzle arrangement of the lower face of the head 41. In addition, FIG. 2 is a diagram of virtually viewing the nozzle arrangement from the upper face of the head 41. Eight nozzle rows in which the plurality of nozzles are lined up at a predetermined distance in the transport direction are formed in the lower face of the head 41. The printer 1 can eject four colors of ink (cyan, yellow, magenta, and black), and is provided with two nozzle rows for each color of ink. In order in the movement direction from the right side, a first cyan nozzle row C1 ejecting cyan ink, a second yellow nozzle row Y2 ejecting yellow ink, a first magenta nozzle row M1 ejecting magenta ink, a second black nozzle row K2 ejecting black ink, a first block nozzle row K1 ejecting black ink, a second magenta nozzle row M2 ejecting magenta ink, a first yellow nozzle row Y1 ejecting yellow ink, and a second cyan nozzle row C2 ejecting cyan ink are provided.

One nozzle row is formed of 180 nozzles, and the nozzle spacing is "180 dpi". One nozzle row (e.g., K1) of the nozzle rows ejecting the same color of ink has a "360 dpi" deviation with respect to the other nozzle row (e.g., K2) to the downstream side in the transport direction. For this reason, the number of nozzles ejecting one color of ink is 360, and the nozzles ejecting one color of ink are arranged in the transport direction at a spacing of 360 dpi in the head 41. For description, odd numbers (#1, #3, #5, . . . ) are given in order from the nozzles on the downstream side belonging to the nozzle row (e.g., K1) deviating to the downstream side between the nozzle rows ejecting the same color of ink, and even numbers (#2, #4, #6, . . . ) are given in order from the nozzles on the downstream side belonging to the nozzle row (e.g., K2) deviating to the upstream side.

In the head 41 shown in FIG. 2, the nozzle rows ejecting the same color of ink are symmetrically disposed. By such disposition, at the time of performing two-direction printing, it is possible to keep the landing order of color ink regular even when the head 41 moves from left to right (forward path) in the movement direction and, conversely, even when the head 41 moves from right to left (backward path). As a result, it is possible to suppress color unevenness generated by a different landing order of color ink.

The printer 1 repeats a dot forming process of discontinuously ejecting ink droplets from the head 41 moving along the movement direction to form dots on the medium, and a transport process of transporting the medium in the transport direction with respect to the head 41. Accordingly, at a position on the medium different from the position of the dots formed by the former dot forming process, dots can be formed in the later dot forming process, and thus it is possible to print a 2-dimension image on the medium. An operation (one dot forming process) of moving the head 41 once in the movement direction while ejecting the ink droplets is called a "pass".

Ink Ejection Time

Figure 3:
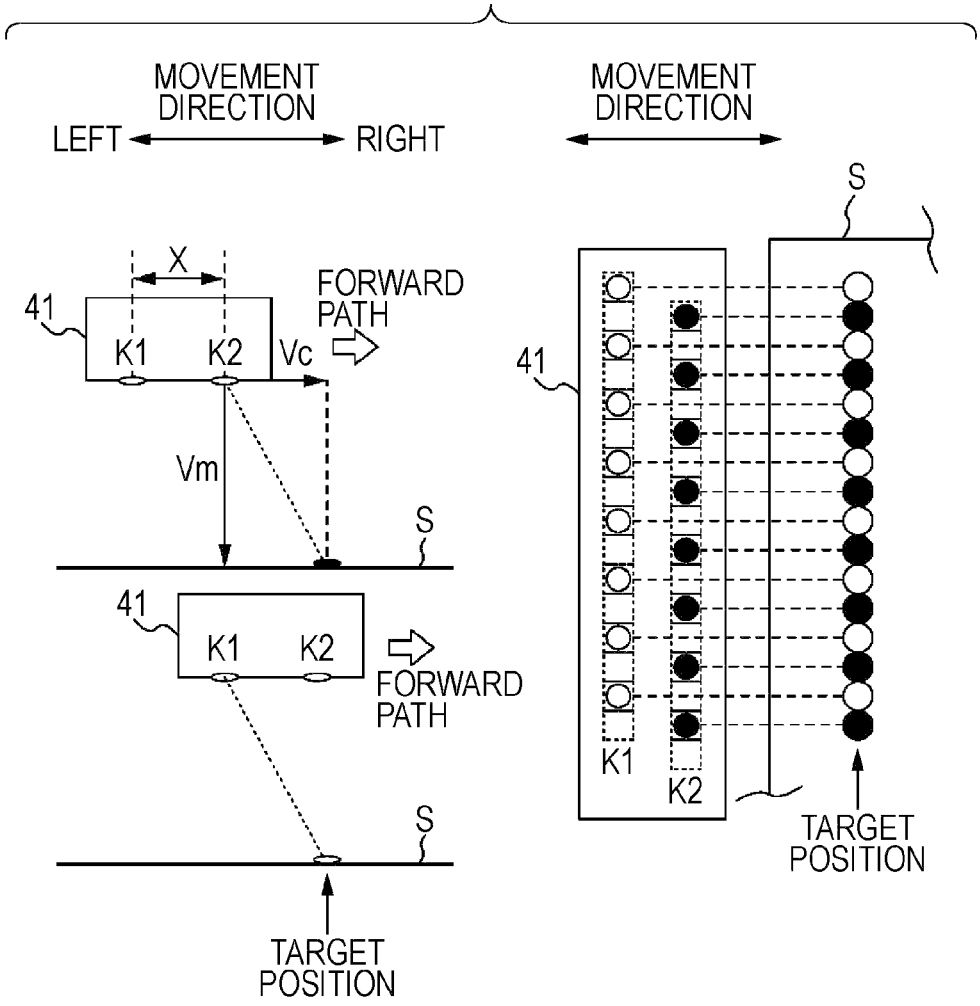
FIG. 3 is a diagram illustrating a difference of ink ejecting timing of a first black nozzle row and a second black nozzle row.

FIG. 3 is a diagram illustrating a difference in ink ejecting timing between the first black nozzle row K1 and the second black nozzle row K2. In FIG. 3, the movement velocity of the head 41 (carriage 31) is "Vc", and the ejection velocity of the ink droplets ejected from the nozzles is "Vm". In the head 41, as shown in FIG. 2, two nozzle rows are provided for one color of ink, and the nozzle rows ejecting the same color of ink are disposed to deviate in the movement direction. The second black nozzle row K2 is positioned on the right side in the movement direction with respect to the first black nozzle row K1. For this reason, at the forward path time of moving the head 41 from left to right in the movement direction, the second black nozzle row K2 is first opposed to the target position on the medium prior to the first black nozzle row K1. Accordingly, as shown on the right of FIG. 3, when the dots formed by the first black nozzle row K1 and the dots formed by the second black nozzle row K2 are formed at the same target position, the ejection time of the first black nozzle row K1 is delayed later than the ejection time of the second black nozzle row K2. Specifically, it is considered that the first black nozzle row K1 and the second black nozzle row K2 are separated from each other by "distance X" in the movement direction. In this case, in design, the ejection time of the first black nozzle row K1 is delayed by a time t (t–X/Vc) of moving the head 41 by the distance X in the movement direction, later than the ejection time of the second black nozzle row K2.

In the printer 1 of the embodiment, since the ink droplets are ejected from the head 41 moving in the movement direction, as shown in FIG. 3, the ink droplets fly in an oblique direction (toward the side where the head 41 moves) to the medium S (with respect to the vertical direction). For this reason, the ink ejection time is set in a design process so as to eject the ink droplets from the former position where the first black nozzle row K1 and the second black nozzle row K2 are opposed to the target position. That is, in design, the ink droplets are ejected from the nozzles at an early timing before predetermined nozzles are opposed to the target position, by the timing when the ink droplets are ejected from the predetermined nozzles and then the ink droplets land onto the medium.

Figure 4:
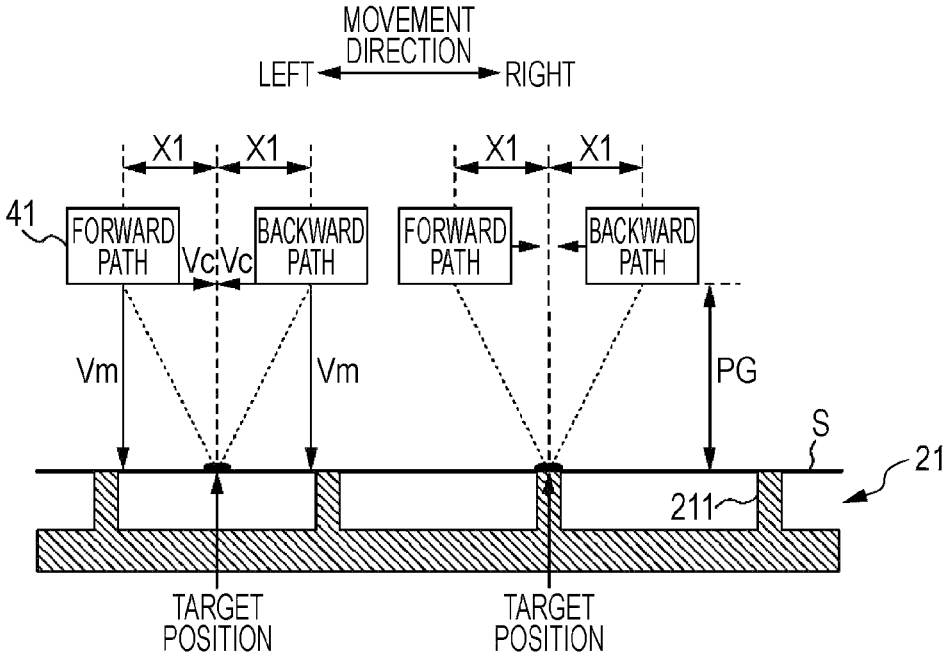
FIG. 4 is a diagram illustrating ink ejecting timing in two-direction printing.

FIG. 4 is a diagram illustrating the ink ejection time in the two-direction printing. The printer 1 performs the two-direction printing of ejecting the ink droplets from the nozzles to form an image even at the "forward path" time of moving the head 41 from left to right in the movement direction and even at the "backward path" time of moving the head 41 from right to left in the movement direction. As described above, in design, the ink droplets are ejected from the nozzles at the early timing before the nozzles are opposed to the target position, by the time when the ink droplets ejected from the nozzles land onto the medium (hereinafter, referred to as landing time).

On the forward path and the backward path, when the movement velocity (Vc) of the head 41, the ejection velocity Vm of ink, and a distance (hereinafter, also referred to as paper gap PG) from the nozzles to the medium are regular (designed values), the flying direction and the landing time of ink at the forward path time and the flying direction and the landing time of ink at the backward path time are regular. In this case, to arrange the dot formation positions of the forward path and the backward path at the target position, it is preferable to eject ink from the nozzles at the same time before the head 41 of the forward path and the backward path reaches the target position. In other words, the ink is ejected from the nozzles when the head 41 is positioned on the left side in the movement direction from the target position by a distance X1 at the forward path time, and the ink is ejected from the nozzles when the head 41 is positioned on the right side in the movement direction from the target position by the distance X1 at the backward path time. Accordingly, it is possible to arrange the forward and backward dot formation positions at the target position.

However, in the actual printer 1, there is a mechanical error in the carriage 31, a difference in characteristics of the head 41, or a difference in characteristics of the forward path and the backward path. For this reason, since the movement velocity Vc of the head 41, the ink ejection velocity Vm, or the paper gap PG is changed or the flying direction of the ink droplets deviates, the dots may not be formed at the target position at the designed ejection time. For example, when the ejection velocity from the nozzles is higher than the designed ejection velocity Vm (not shown), the ink droplets land onto a position (the opposite position of the head movement direction) ahead of the target position. In this case, particularly, when the two-direction printing is performed, the dots land deviated to the left side in the movement direction from the target position at the forward path time, and land deviated to the right side in the movement direction from the target position at the backward path time. That is, the dot formation position of the forward path and the dot formation position of the backward path greatly deviate in the movement direction of the head 41. When the forward and backward dot formation positions deviate, joint of the image formed on the forward path and the image formed on the backward path is not satisfactory, and image quality of the printed image deteriorates.

In the printer 1 of the embodiment, "Bid adjustment value" for adjusting the ink ejection time of the forward path and the backward path from the designed ejection time is calculated according to individual characteristics of the printer 1 in a mass-production process (or maintenance, etc.). Thus, the dot formation position of the forward path and the dot formation position of the backward path in the head movement direction are arranged to suppress the image deterioration. For example, when the ink ejection velocity Vm is higher than the designed value as described above, it is preferable that the ejection time of the forward path and the backward path is delayed later than the designed ejection time. In such a manner, the dot formation position of the forward path is corrected to the right side and the dot formation position of the backward path is corrected to the left side. Accordingly, it is possible to arrange the forward and backward dot formation positions in the head movement direction.

Landing Position Deviation Caused by Cockling Phenomenon

Figure 5:
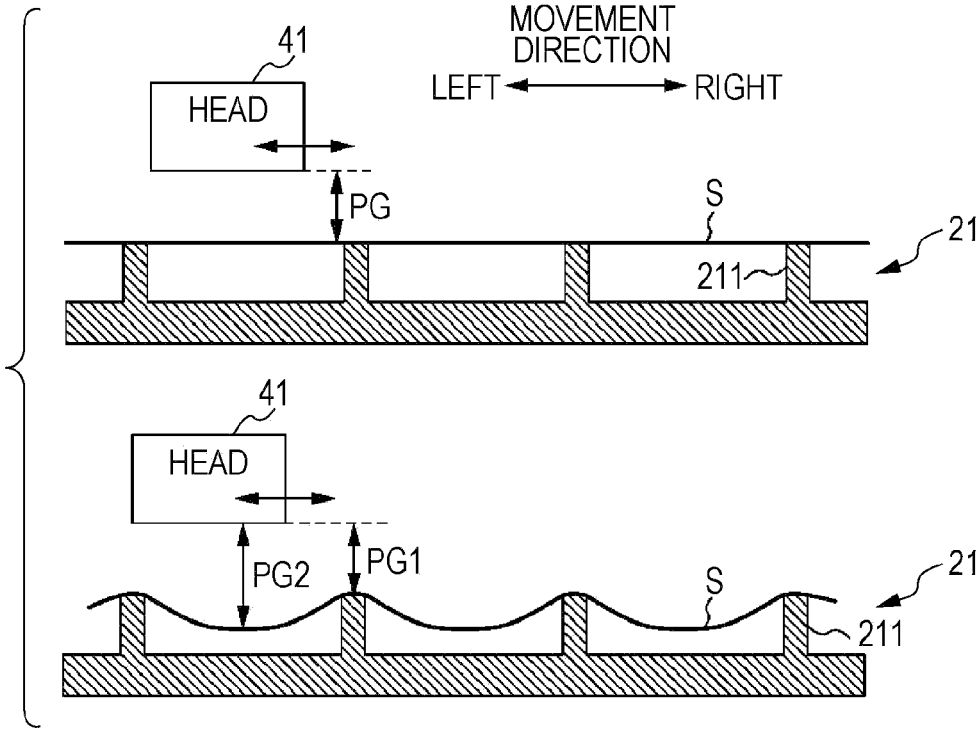
FIG. 5 is a diagram illustrating change of a paper gap when a cockling phenomenon occurs.

FIG. 5 is a diagram illustrating change of the paper gap when the cockling phenomenon occurs on the medium. In the printer 1 of the embodiment, a platen 21 is provided at a position opposed to the nozzle face of the head 41 moving in the movement direction. A plurality of convex portions 211 (ribs) protruding upward are provided on the upper face of the platen 21. The convex portions 211 grow in the transport direction according to the nozzle row length of the head 41. The plurality of convex portions 211 are provided at a predetermined distance in the movement direction. As shown in FIG. 5, when the medium S is opposed to the head 41, the medium S is supported from the lower part by the convex portions 211 of the platen 21.

The printer 1 may perform non-edge printing of forming an image even at the edge of the medium such that there is no margin at the periphery of the medium S. However, the image formation position on the medium may deviate by a transport error of the medium or deviation of the dot formation position. For this reason, at the time of the non-edge printing, ink is ejected in the range wider than the medium. In the case, since the platen 21 is provided with the convex portions 211, it is possible to eject ink, which does not land onto the medium S, into concave portions between the convex portions 211. In such a manner, it is possible to prevent the ink from being attached to the part of the platen coming in contact with the medium S, and thus it is possible to prevent the medium S from being stained.

As described above, the paper gap PG that is the distance from the nozzle face to the medium has an influence on the time when the ink droplets are ejected from the nozzles and then land onto the medium. For this reason, the paper gap PG is considered to determine the ink ejection time from the nozzles in the production process (design process or mass-production process). Accordingly, when the paper gap PG is changed, the dot formation position is changed. Thus, it is possible to keep the paper gap PG regular by supporting the medium S from the lower part by the convex portions 211 of the platen 21 when the medium surface is regular (horizontal) as shown at the upper part of FIG. 5. The height of the convex portions 211 of the platen 21 is determined according to an attachment height of the head 41 such that the distance from the nozzle face of the head 41 to the medium S is the designed paper gap PG. When a platen gap PG is regular, it is possible to suppress the deviation of the dot formation positions of the forward path and the backward path by ejecting ink at the ejection time (the timing for using the Bid adjustment value)

set in the design process or at the ejecting time adjusted for every printer in the mass-production process.

However, in a medium absorbing a solvent component of ink (e.g., water) such as normal paper, the part of the medium absorbing ink swells. For this reason, as a result of forming an image on the medium S, as shown in FIG. 5, a phenomenon (hereinafter, referred to as a cockling phenomenon) of cockling of the medium S may occur. As described in the embodiment, when the platen 21 provided with the plurality of convex portions 211 at the predetermined distance in the movement direction is used and the cockling phenomenon occurs on the medium, the medium S is easily bent downward in the concave portions between the convex portions 211. As a result, the paper gap PG2 of the parts of the medium positioned in the concave portions becomes larger than the paper gap PG when the cockling phenomenon does not occur on the medium S or the paper gap PG1 of the parts of the medium supported by the convex portions 211. Particularly, a paper gap of the part of the medium positioned between two convex portions 211 arranged in the movement direction becomes easily the largest paper gap.

Figure 6:
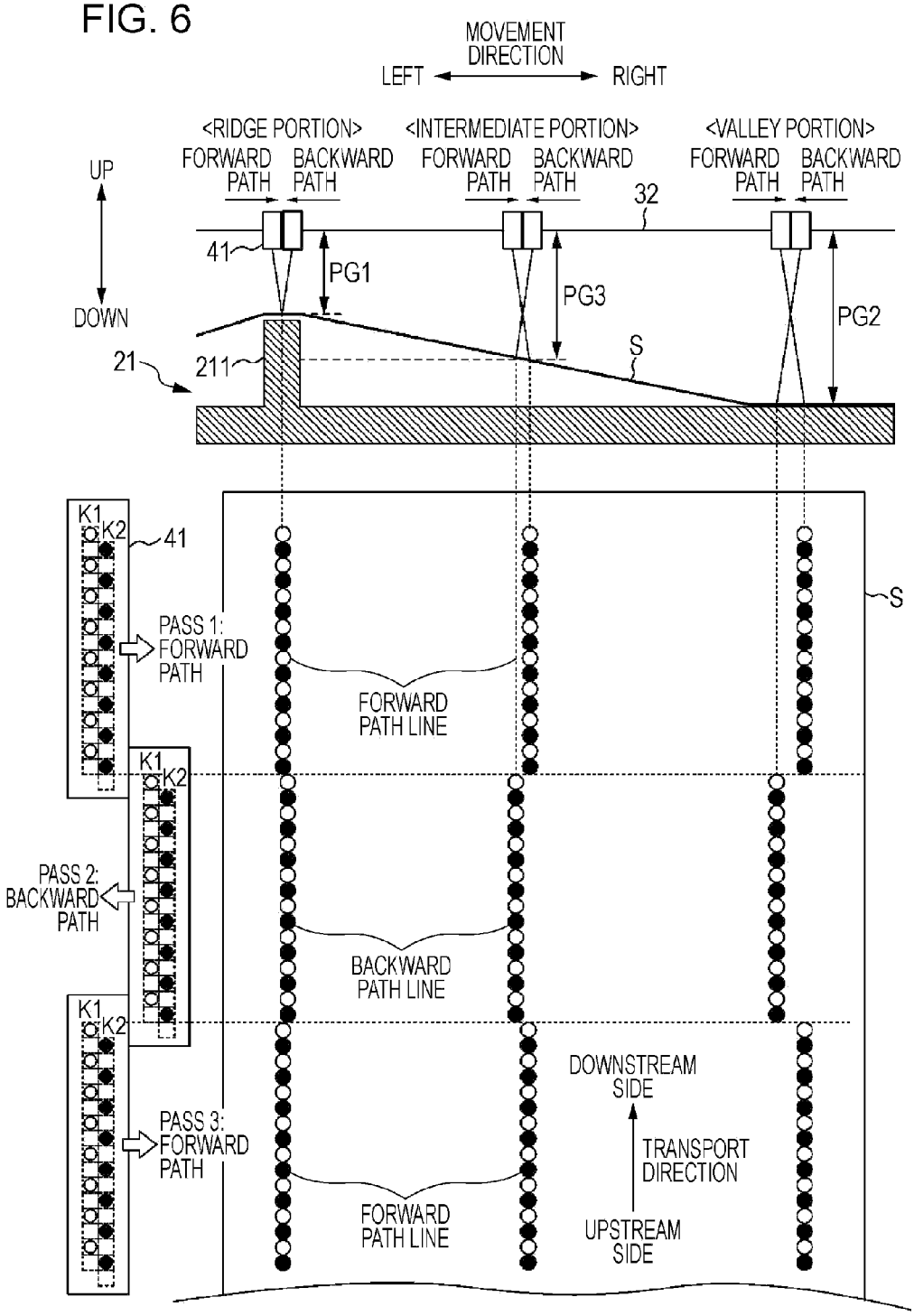
FIG. 6 is a diagram illustrating forward and backward landing position misalignment on a medium where a cockling phenomenon occurs.

FIG. 6 is a diagram illustrating the forward and backward landing position deviation in the medium S on which the cockling phenomenon occurs. For the following description, the part of the medium S supported by the convex portions 211 of the platen 21 is referred to as "ridge portion" of the medium S, and the part of the medium positioned between the convex portions 211 arranged in the movement direction is referred to as "valley portion" of the medium S. The part of the medium between the ridge portion and the valley portion is referred to as an "intermediate portion" of the medium S. FIG. 6 shows a feature of forming lines along the transport direction by the two-direction printing at the ridge portion, the intermediate portion, and the valley portion of the medium S. The lines along the transport direction are formed in three passes by the black nozzle rows K1 and K2 and band printing. Band printing is a printing method in which a band image formed in one pass is arranged in the transport direction, and dots are not formed in the other pass between the dots formed in any pass.

In FIG. 6, the dots of the first black nozzle row K1 (hereinafter, referred to as K1 row) are indicated by white circles (o), and the dots of the second black nozzle row K2 (hereinafter, referred to as K2 row) are indicated by black circles (•). Since the K1 row and the K2 row deviates in the transport direction by a half of nozzle pitches of the nozzle rows, lines in which the dots (o) formed by the K1 row and the dots (•) formed by the K2 row are alternately arranged are formed in one pass. In the production process of the printer 1, the ejection time of two nozzle rows (K1 and K2) is set such that the dot formation position in the movement direction of the K1 row and the dot formation position in the movement direction of the K2 row coincide with each other.

In FIG. 6, the parts of the medium positioned at the convex portions 211 slightly float from the convex portions 211 by the cockling phenomenon, and the medium between the convex portions 211 arranged in the movement direction is bent downward. For this reason, the paper gap PG1 of the ridge portions of the medium S positioned at the convex portions 211 is slightly smaller than the designed paper gap PG, and the paper gap PG2 of the valley portions of the medium S is drastically larger than the designed paper gap PG. The paper gap PG3 of the intermediate portions between the ridge portions and the valley portions of the medium S is a middle length of the paper gap PG1 of the ridge portions and the paper gap PG2 of the valley portions.

In the production process of the printer 1, when the paper gap is the designed value PG, the ejection time is set such that the dot formation positions in the movement direction of the forward path and the backward path of the nozzle rows K1 and K2 coincide with each other (the Bid adjustment value is set). For this reason, as shown in FIG. 6, the line along the transport direction formed at the ridge portions of the medium S is a relatively straight line in the transport direction although the forward path line (passes 1 and 2) deviates to the left side in the movement direction and the backward path line (pass 3) deviates to the right side in the movement direction. However, the forward path line drastically deviates to the right side and the backward path line drastically deviates to the left side as it goes to the intermediate portion and the valley portion of the medium S. As a result, the amounts of the deviations in the movement direction of the forward path line and the backward path line become large.

That is, when the cockling phenomenon occurs on the medium S and the actual paper gap deviates from the paper gap (designed paper gap PG) at the time of arranging the dot formation positions in the movement direction of the forward path and the backward path, the dot formation positions in the movement direction of the forward path and the backward path deviates. As described above, when the image formed on the forward path and the image formed on the backward path deviate in the movement direction, joint of the image is not satisfactory, and the printed image deteriorates. Particularly, as shown in FIG. 6, when one line is formed on the forward path and the backward path, a straight line may not be formed along the transport direction, a boundary line of the forward path line and the back ward path line is visible, and the printed image deteriorates. Thus, the embodiment is to reduce the deterioration of the printed image, even when the cockling phenomenon occurs on the medium S and the paper gap is changed from the paper gap PG (designed value) at the time of adjusting the dot formation positions in the movement direction of the forward path and the backward path (at the time of calculating the Bid adjustment value).

Adjustment of Landing Position Deviation Caused by Cockling Phenomenon

Adjustment Method of Comparative Example

Figure 7:
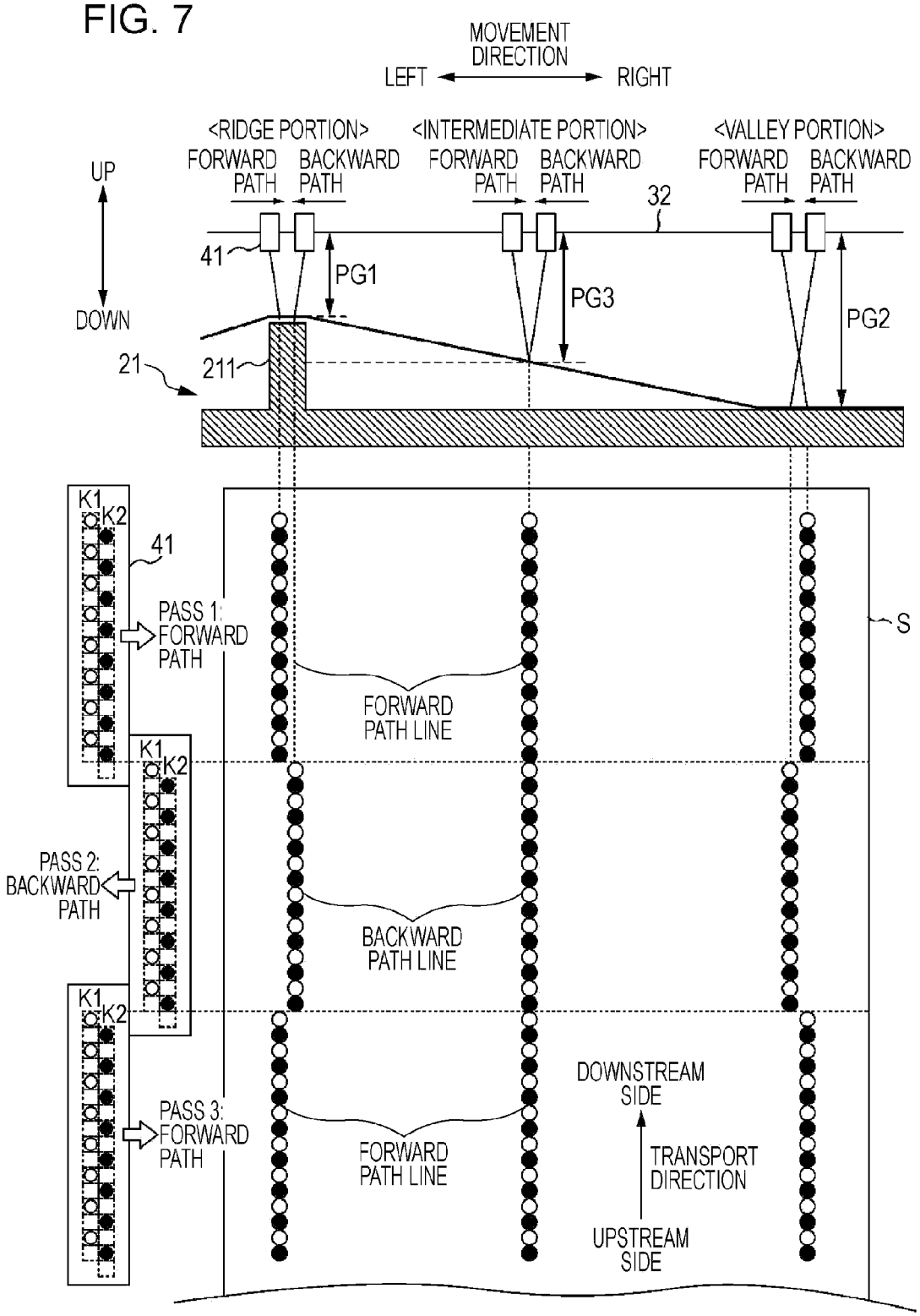
FIG. 7 is a diagram illustrating an adjustment method of a comparative example with respect to landing position misalignment caused by a cockling phenomenon.

FIG. 7 is a diagram illustrating an adjustment method of a comparative example with respect to landing position deviation caused by the cockling phenomenon. In the comparative example, when an image is printed on the medium on which the cockling phenomenon occurs, the ink ejection time is adjusted such that the dot formation positions in the movement direction of the forward path and the backward path at the intermediate portions of the medium S coincide with each other. That is, in the medium on which the cockling phenomenon occurs, the ejection time of the forward path and the backward path is set according to the paper gap between the minimum value of the paper gap (PG1 of the ridge portion) and the maximum value of the paper gap (PG2 of the valley portion).

As a result, as shown in FIG. 7, in the line formed at the intermediate portion of the medium S, a straight line along the transport direction is formed without deviation of the forward path line and the backward path line in the movement direction. Since the platen gap PG1 of the ridge portion of the medium S is smaller than that of the intermediate portion, the dots are formed on the side (the opposite side of the head movement direction) ahead of the target portions. Specifically, the dots are formed such that the forward path line deviates from the target position to the left side in the movement direction, and the backward path line deviates from the target position to the right side. For this reason, the line formed at the ridge portion of the medium S is formed of the forward path line and the backward path line deviating in the movement direction, and is not a straight line along the transport direction as compared with the line formed at the intermediate portion of the medium S. However, the deviation in the movement direction of the forward path line and the backward path line of the ridge portion formed by the adjustment method of the comparative example is small as compared with the forward path line and the backward path line formed at the valley portion of the medium S shown in FIG. 6.

At the valley portion of the medium S, since the platen gap PG2 is larger than that of the intermediate portion, the dots are formed at a position (the head movement direction side) proceeding ahead of the target position. Specifically, the forward path line deviates from the target position to the right side in the movement direction, and the backward path line deviates from the target position to the left side. For this reason, the line formed at the valley portion of the medium S, in which the forward path line and the backward path line deviate in the movement direction, is also not a straight line along the transport direction as compared with the line formed at the intermediate portion of the medium S. However, the deviation in the movement direction of the forward path line and the backward path line of the valley portion formed by the adjustment method of the comparative example is small as compared with the forward path line and the backward path line formed at the valley portion of the medium S shown in FIG. 6.

The reason is, in the paper gap, because the deviation of the dot formation positions in the movement direction of the forward path and the backward path gets larger as the amount of deviation from the platen gap (PG3 of the intermediate portion in the comparative example) at the time of adjusting the dot formation positions in the movement direction of the forward path and the backward path becomes larger. For this reason, as shown in FIG. 6 described above, when the forward and backward ejection time is adjusted according to the designed paper gap PG (a value close to PG1 of the ridge portion) without considering that the cockling phenomenon occurs, the deviation of the dot formation positions of the forward path and the backward path at the valley portion of the medium S becomes large.

In the adjustment method of the comparative example, the forward and backward ejection time is adjusted according to the middle platen gap PG3 between the minimum value (PG1 of the ridge portion) and the maximum value (PG2 of the valley portion) of the platen gap at the time when the cockling phenomenon occurs on the medium. For this reason, the difference between the platen gap (PG3 of the intermediate portion) with the adjusted forward and backward ejecting time and the platen gap (e.g., PG1 of the ridge portion or PG2 of the valley portion) of various positions of the medium S can be decreased as small as possible. As a result, the deviation of the dot formation positions in the movement direction of the forward path and the backward path can be suppressed as much as possible.

However, even when the deviation of the dot formation positions in the forward and backward movement direction is suppressed as much as possible by the adjustment method of the comparative example, joint of the image is not satisfactory, and the image quality deteriorates when the image formed on the forward path and the image formed on the backward path deviate in the movement direction. Particularly, as shown in the example of FIG. 7, when the lines along the transport direction are formed on the forward path and the backward path, the boundary line of the forward path line and the backward path line is visible.

Adjustment Method of Present Embodiment

Figure 8:
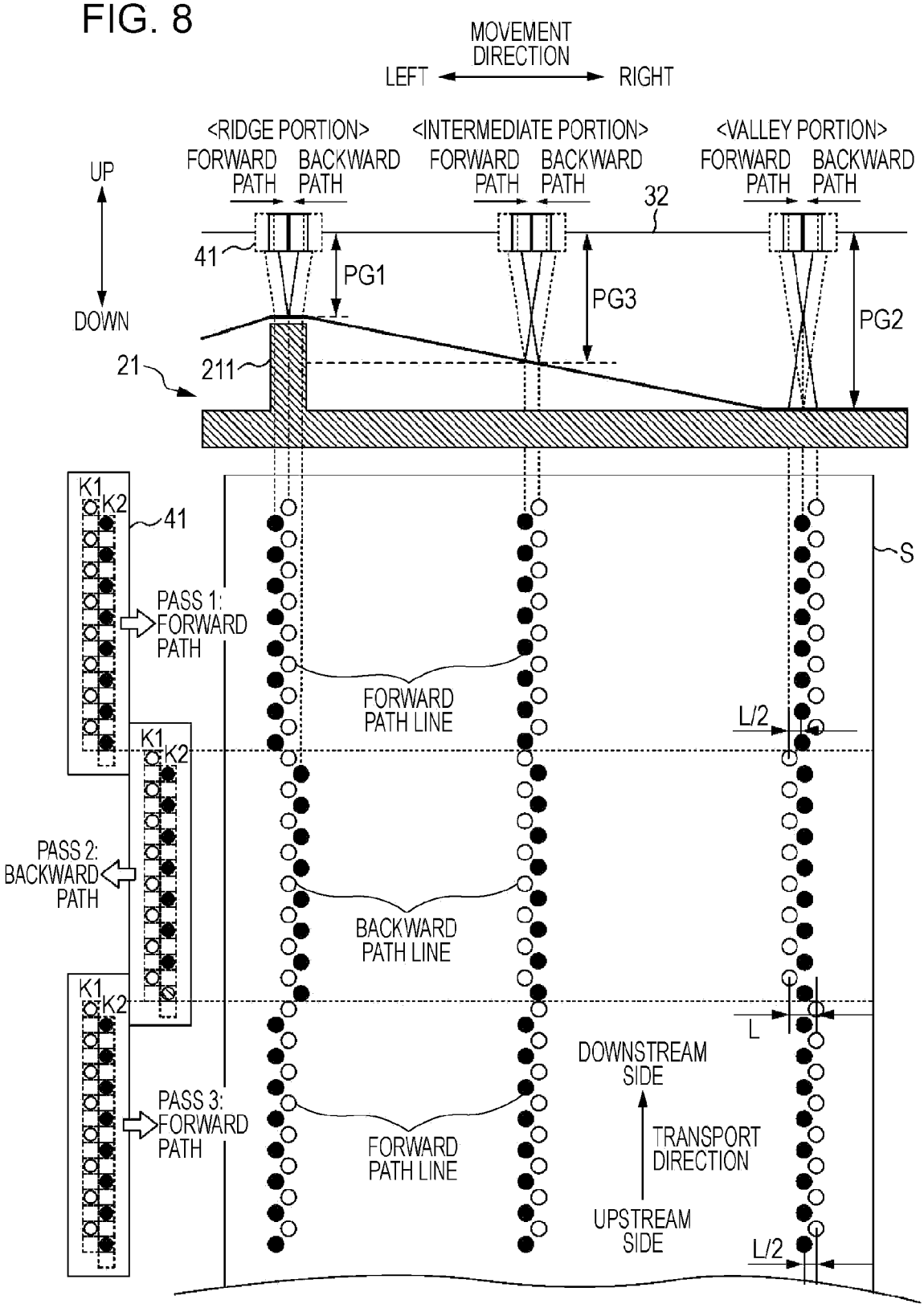
FIG. 8 is a diagram illustrating an adjustment method of the embodiment with respect to landing position misalignment caused by a cockling phenomenon.

FIG. 8 is a diagram illustrating an adjustment method of the embodiment with respect to the landing position deviation caused by the cockling phenomenon. In the printer 1 of the embodiment, the head 41 is provided with two nozzle rows for one color of ink (see FIG. 2). Two nozzle rows ejecting the same color of ink deviate by a half of the nozzle pitch in the transport direction. For this reason, as shown in FIG. 8, the dots (o) formed by one nozzle row and the dots (•) formed by the other nozzle row of two nozzle rows (K1 and K2) ejecting the same color of ink are alternately arranged in the transport direction to form one line.

In the adjustment method of the embodiment, at the ridge portion of the medium S, the ejection time of the forward path and the backward path of the K1 row is adjusted such that the dot formation positions (o) in the movement direction of the forward path and the backward path of one K1 row (reference row corresponding to the first nozzle row) of two nozzle rows (K1 and K2) ejecting the same color of ink coincide with each other, that is, according to the paper gap PG1. For this reason, at the ridge portion of the medium S, the dots (o) of the K1 row are arranged in a straight line in the transport direction irrespective of the forward path and the backward path.

The ink ejection time of the K2 row is adjusted such that the dots of the K2 row (adjustment row corresponding to the second nozzle row) is formed on the front side (the side opposite to the movement side of the head) in the movement direction with respect to the dots of the K1 row (reference row). For this reason, as shown in FIG. 8, the dots (•) of the K2 row is formed to deviate to the left side in the movement direction with respect to the dots (o) of the K1 row at the forward path time, and the dots (•) of the K2 row is formed to deviate to the right side in the movement direction with respect to the dots (o) of the K1 row at the backward path time. That is, in the adjustment method of the comparative example (FIG. 7), the ejection time of two nozzle rows is set such that the dot formation positions of two nozzle rows (K1 and K2) ejecting the same color of ink does not deviate in the movement direction, but in the adjustment method of the embodiment (FIG. 8), the dots of the K2 row are shifted at the position of the front side of the head movement direction with respect to the dots of the K1 row. In the upper part of FIG. 8, the position of the head 41 indicated by a solid line is a position of the head 41 at the time of ejecting ink from the K1 row, and the position of the head 41 indicated by a dotted line is a position of the head 41 at the time of ejecting ink from the K2 row.

When the ink ejection time is adjusted in such a manner to form an image on the medium S on which the cockling phenomenon occurs, first, at the ridge portion of the medium S, the dots (o) of the K1 row that is the reference row are arranged in a straight line in the transport direction. For this reason, the boundary line of the forward path line and the backward path line may not be visible. Paying attention to only the dots (•) of the K2 row that is the adjustment row, the dots of the K2 row of the forward path and the dots of the K2 row of the backward path deviate in the movement direction. However, since the dots of the K1 row are positioned between the dots of the K2 row of the forward path and the dots of the K2 row of the backward path, the deviation of the forward and backward dot formation positions of the K2 row is invisible.

That is, in the adjustment method of the embodiment, the dot formation positions of two nozzle rows (K1 and K2)

ejecting the same color of ink are shifted in the movement direction, thereby forming a relatively thick line. At the ridge portion of the medium S, the line at the backward path time deviates to the right side in the movement direction with respect to the line at the forward path time. However, the line is thick, and thus the joint can be hardly visible since the position in the movement direction of the forward path line is partially overlapped with the position in the movement direction of the backward path line. That is, the forward path line and the backward path line are made thick, and the whole line is made vague, such that the joint of the forward path line and the backward path line is made invisible. The embodiment is not limited to the case of forming the line. According to the adjustment method of the embodiment, it is possible to reduce the dissatisfaction of the joint of the image formed on the forward path and the image formed on the backward path.

At the intermediate portion of the medium S, the paper gap PG3 becomes larger than that of the ridge portion. Since the forward and backward ejection time is adjusted such that the dot formation positions of the forward path and the backward path of the K1 row (reference row) at the ridge portion coincide with each other, the dots of the K1 row of the forward path deviate to the right side in the movement direction and the dots of the K1 row of the backward path deviate to the left side in the movement direction, at the intermediate portion. However, since the dots of the K2 row are shifted on the side opposite to the head movement direction with respect to the dots of the K1 row, deviation in the movement direction of the dots (o) of the K1 row of the forward path and the dots (•) of the K2 row of the backward path is small, and deviation in the movement direction of the dots (•) of the K2 row of the forward path and the dots (o) of the K1 row of the backward path is small, as shown in FIG. 8. That is, at the intermediate portion of the medium S, the position deviation in the movement direction of the relatively thick line formed on the forward path and the relatively thick line formed on the backward path is small, and the joint of the forward path and the backward path is hardly visible.

Since the paper gap PG2 gets larger at the valley portion of the medium S, the dots of the K1 row (reference row) in which the forward and backward dot formation positions are adjusted at the ridge portion deviate to the right side in the movement direction at the forward path time, and deviate to the left side in the movement direction at the backward path time. However, the dots of the K2 row (adjustment row) are formed at a position of the front side (the opposite side of the head movement direction) with respect to the dots of the K1 row. For this reason, position deviation in the movement direction of the dots of the K2 row of the forward path and the dots of the K2 row of the backward path is small, and the joint of the forward path and the backward path is hardly visible. In the whole line, the position in the movement direction of the thick line of the forward path is partially overlapped with the position in the movement direction of the thick line of the backward path, and the joint can be made hardly visible.

Figure 9:
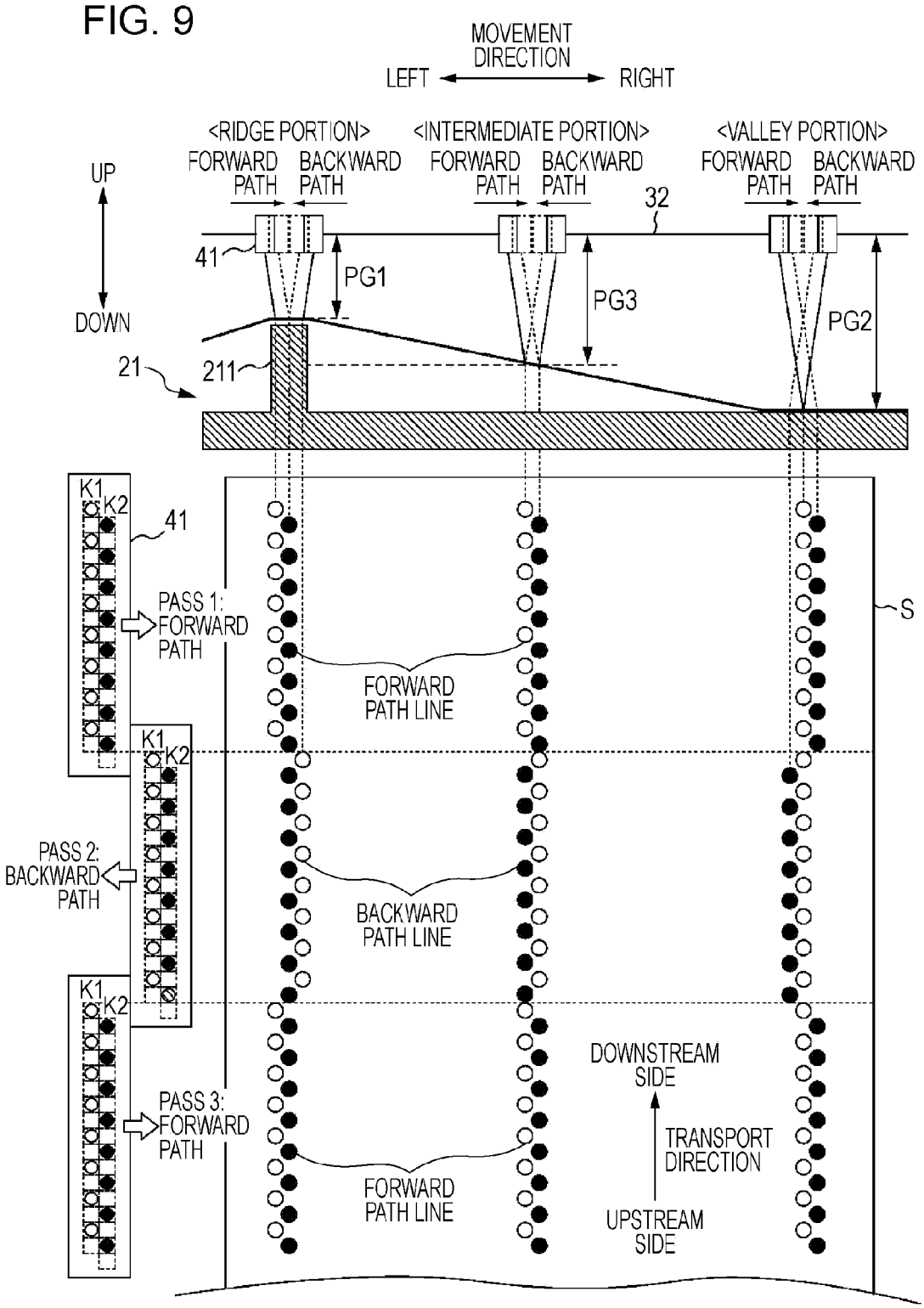
FIG. 9 is a diagram illustrating a case where dot formation positions on a forward path and a backward path of a reference row are arranged in a valley portion of a medium.

FIG. 9 is a diagram illustrating a case of arranging the dot formation positions of the forward path and the backward path of the reference row (K1 row) at the valley portion of the medium S. In the above-described example (FIG. 8), the dot formation positions of the forward path and the backward path in the movement direction of the reference row (K1 row) are arranged at the ridge portion of the medium S, but the embodiment is not limited thereto. The dot formation positions of the forward path and the backward path in the movement direction of the reference row (K1 row) may be arranged at the valley portion of the medium S. However, in this case, the dots of the K2 row is formed to be shifted at the front position (the position of the side where the head 41 moves) with respect to the dots of the K1 row (reference row). In the upper part of FIG. 9, the position of the head 41 indicated by a solid line is a position of the head 41 at the time of ejecting ink from the K1 row, and the position of the head 41 indicated by a dotted line is a position of the head 41 at the time of ejecting ink from the K2 row.

For this reason, in FIG. 9, at the valley portion of the medium S, the position in the movement direction of the dots of the forward path row and the dots of the backward path of the K1 row coincide with each other, and the joint of the forward path and the backward path can be made hardly visible. Since the dots of the K2 row are positioned on the side where the head 41 moves with respect to the dots of the K1 row, the dots of the K2 row of the forward path are positioned on the right side in the movement direction, and the dots of the K2 row of the backward path are positioned on the left side in the movement direction. However, since the dots of the K1 row are positioned between the dots of the K2 row of the forward path and the dots of the K2 row of the backward path, the joint of the forward path and the backward path can be made hardly visible. That is, in the whole line, the thick line of the forward path is positioned on the right side in the movement direction, and the thick line of the backward path is positioned on the left side, but the position in the movement direction of the thick line of the forward path is partially overlapped with the position in the movement direction of the thick line of the backward path, and the joint can be made hardly visible.

Similarly, at the intermediate portion of the medium S, deviation in the movement direction of the thick line of the forward path and the thick line of the backward path is small, and the joint of the forward path and the backward path is hardly visible. At the ridge portion of the medium S, deviation in the movement direction of the dot formation positions of the forward path and the backward path of the K2 row (adjustment row) is small, and the thick line of the backward line deviates to the right side in the movement direction with respect to the thick line of the forward path. However, since the positions in the movement direction of two lines are partially overlapped with each other, the joint can be made hardly visible.

As described above, in the adjustment method of the embodiment, at the ridge portion or the valley portion of the medium S, the forward and backward dot formation positions of one reference row of two nozzle rows (K1 and K2) ejecting the same color of ink are arranged. The dot formation position of the other adjustment row is shifted with respect to the dot formation position of the reference row. However, the forward and backward dot formation positions of the reference row at the intermediate portion of the medium S may not be arranged. For example, it is assumed that the dot formation positions of the K1 row are arranged at the intermediate portion and the dot formation positions of the K2 row are adjusted to the front side (the opposite side of the head movement direction) with respect to the dot formation positions of the K1 row as shown in FIG. 8. Then, at the ridge portion of the medium S, the dots of the K1 row of the forward path deviate to the left side in the movement direction with respect to the dots of the K1 row of the backward path, and the dots of the K2 row of the forward path further deviate to the left side in the movement direction with respect to the dots of the K2 row of the backward path. As described above, when the forward and backward dot formation positions of the reference row are arranged at the intermediate portion of the medium S, the joint of the forward path line and the backward path line cannot be made hardly visible according to the position of the medium (in the ridge portion or the valley portion).

Herein, the K1 row of two nozzle rows (K1 row and K2 row) ejecting the same color of ink is the reference row, the dot formation positions in the movement direction of the forward path and the backward path are arranged at the ridge portion or the valley portion of the medium S, but the invention is not limited thereto. At the ridge portion or the valley portion of the medium S considering the K2 row as the reference row, the dot formed portions in the movement direction of the forward path and the backward path may be arranged, and the dot formation position of the K1 row (adjustment row) may be shifted in the movement direction with reference to the dot formation position of the K2 row. The invention is not limited to alternately forming the dots of the K1 row and the K2 row in the transport direction, and the dots of the same nozzle row may be continuously printed at a plurality of distances.

Calculating of Cockling Adjustment Value R

Figure 10:
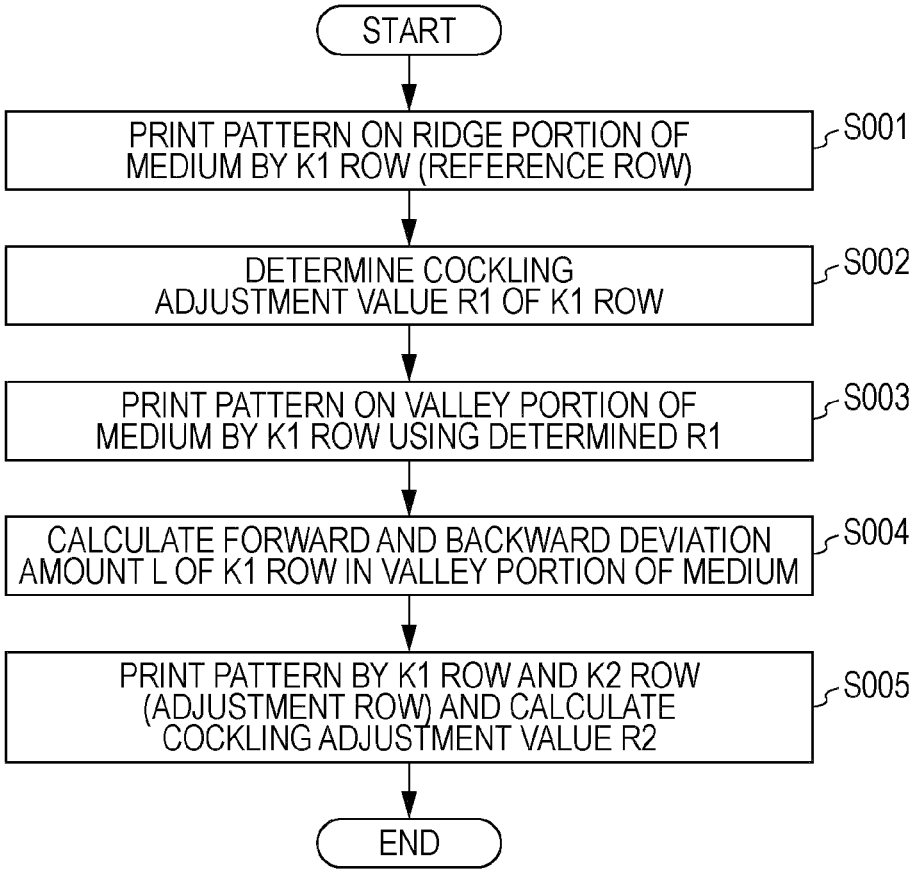
FIG. 10 is a flowchart illustrating calculation of a cockling adjustment value.
Figure 11:
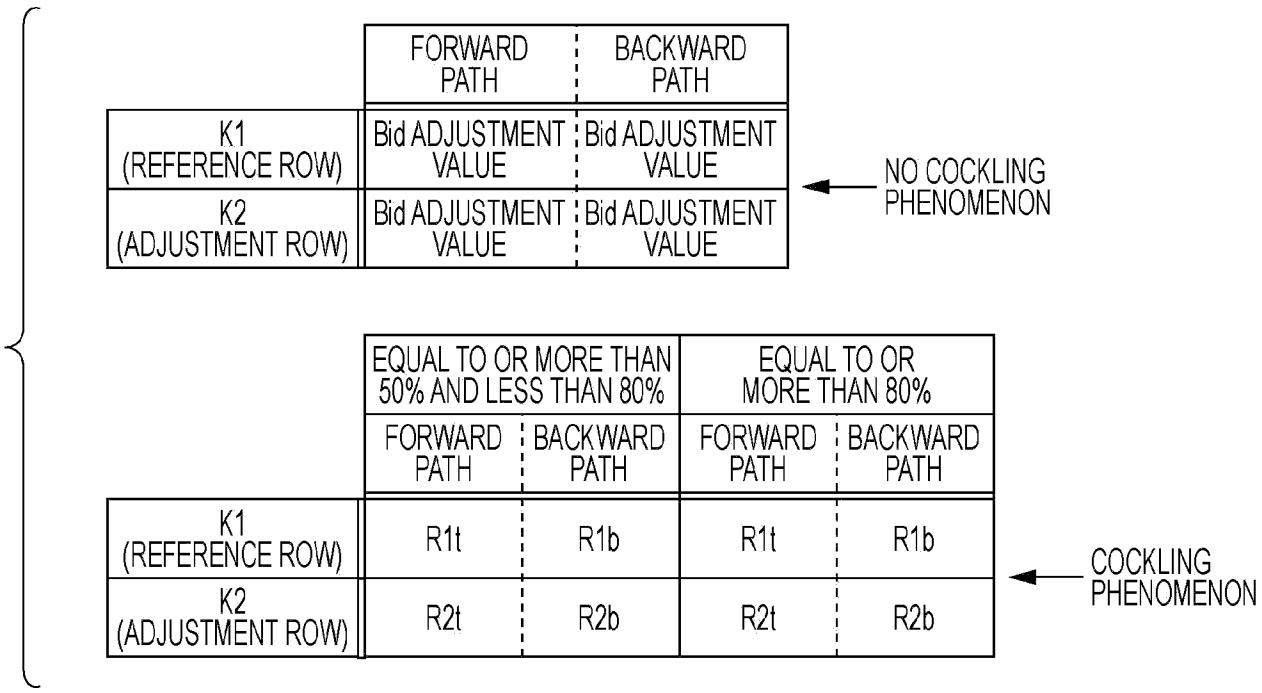
FIG. 11 is a diagram illustrating an adjustment value stored in a memory.

FIG. 10 is a calculation flow of "cockling adjustment value R" for adjusting the ejection time of the forward path and the backward path when the cockling phenomenon occurs on the medium S. FIG. 11 is a diagram illustrating an adjustment value stored in the memory of the printer 1. For each nozzle row (YMCK) ejecting the same color of ink, the cockling adjustment value R for making the joint of the image formed on the forward path and the image formed on the backward path hardly visible is calculated. Hereinafter, for simple description, the black nozzle rows (K1 and K2) will be described by way of example.

In the design process, as shown in FIG. 4, the time of ejecting ink from the nozzles is determined by the ejection velocity Vm of ink droplets, the movement velocity Vc of the head 41, and the paper gap PG. However, as described above, there is a case where the dots may not be formed at the target position at the designed ejection time due to the characteristics of individual printers. In this case, when the two-direction printing is performed, deviation of the dot formation positions in the movement direction of the forward path and the backward path becomes large. Thus, in the mass-production process or the like of the printer 1, a "Bid adjustment value" for adjusting the ink ejection time of the forward path and the backward path from the designed ejection time is calculated for each printer 1. As shown in FIG. 11, the Bid adjustment value is stored in the memory 13 of the printer 1. When the cockling phenomenon does not occur, the printing is performed using the Bid adjustment value. The cockling adjustment value R is also calculated for each printer 1 according to the individual characteristics of the printer in the mass-production process (or maintenance time, etc.) of the printer 1 in the same manner as the Bid adjustment value.

The amount of ink ejected to the medium varies according to a printed image, and a method of occurrence of the cockling phenomenon is different. When the amount of ink ejected to the medium is small, no cockling phenomenon occurs. Thus, in the adjustment method of the embodiment, it is determined whether or not to perform the printing using the cockling adjustment value R according to the amount of ink ejected to the medium. As the amount of ink ejected to the medium gets larger, the medium S positioned between the convex portions 211 of the platen 21 is more easily bent downward, and a difference of the platen gap PG at the valley portion and the ridge portion of the medium S gets larger. Thus, in the adjustment method of the embodiment, the cockling adjustment value R is changed according to the amount of ink ejected to the medium (according to the change amount of the platen gap PG). Herein, it is determined whether or not to use the cockling adjustment value R according to an "ink duty", and the used cockling adjustment R is determined. The ink duty is the ratio of the number of dots actually ejected to a unit area with respect to the number of dots capable of being ejected to the unit area of the medium S (the ratio of the number of actually ejected dots in one pass to the number of dots capable of being ejected in one pass).

In the embodiment, when the ink duty is 50% or higher, it is assumed that the cockling phenomenon shown at the lower part of FIG. 5 occurs. For this reason, when the ink duty is lower than 50%, the printing is performed using the Bid adjustment value shown in FIG. 11. When the ink duty is 50% or higher, the printing is performed using the cockling adjustment value R shown in FIG. 11. Additionally, when the cockling adjustment value R when the ink duty is 50% or higher and lower than 80%, the cockling adjustment value R when the ink duty is 80% or higher is adjusted to be different.

Figure 12:
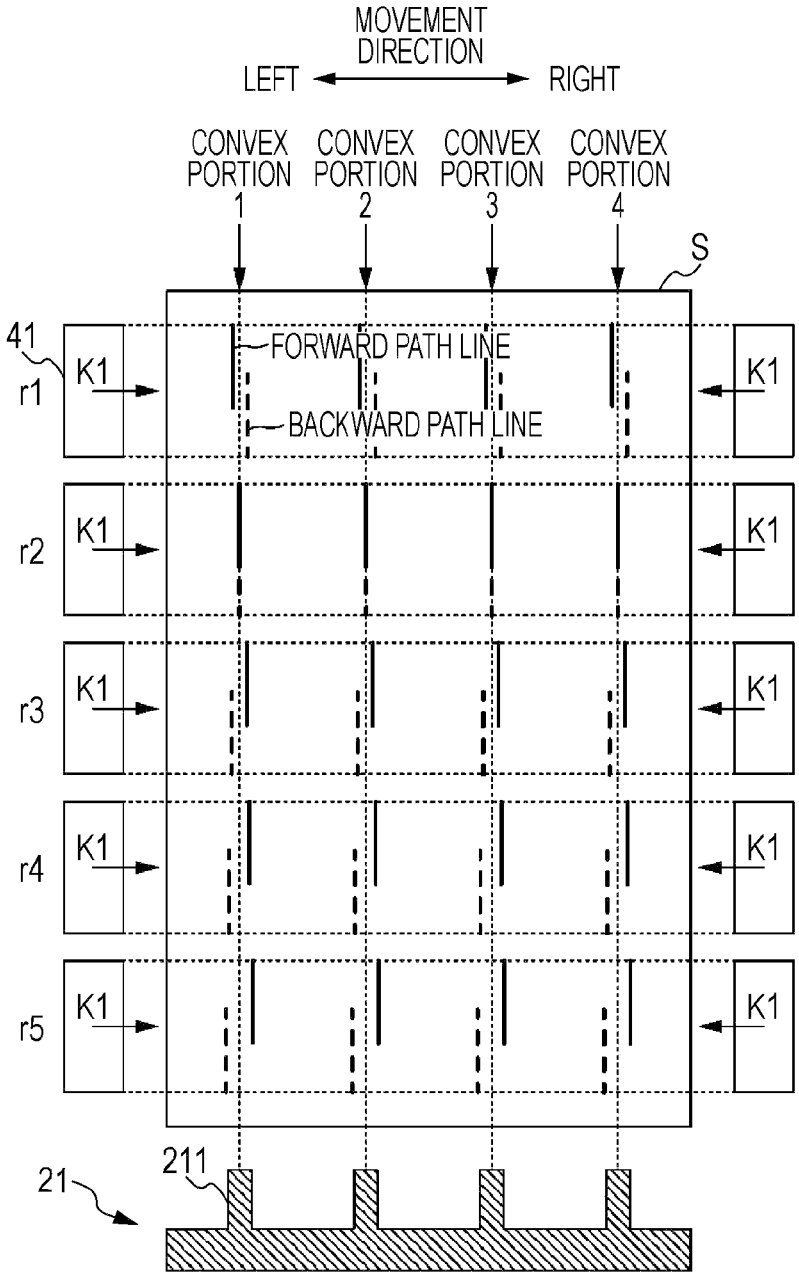
FIG. 12 is a diagram illustrating a pattern to arrange forward and backward dot formation positions of a reference row in a ridge portion of a medium.

FIG. 12 is a diagram illustrating a pattern to arrange the dot formation positions of the forward path and the backward path of the reference row (K1) at the ridge portions of the medium S. First, in the mass-production process or the like of the printer 1, a tester makes the printer 1 that is a test target print the pattern shown in FIG. 12 using the reference row (K1 row). The pattern has the part of the medium supported by the convex portions 211 of the platen 21, that is, "forward path line (solid line)" and "backward path line (dotted line)" formed at the ridge portions of the medium S. On the medium S on which the pattern is printed, ink is ejected from the other nozzle row that is not the K1 row of the test target, and thus the cockling phenomenon occurs. However, the invention is not limited thereto, the paper gap at the time of printing the pattern may be made coincide with the paper gap (for example, PG1 in FIG. 8) of the ridge portions of the medium S of the time when the cockling phenomenon occurs, to print the pattern by the K1 row.

The platen 21 is provided with the plurality of convex portions 211 at a predetermined distance in the movement direction. For this reason, the K1 row forms the forward path line and the backward path line at the parts of the medium supported by the plurality of convex portions 211 (in FIG. 12, four convex portions 1 to 4). The ejection time of the forward path and the backward path is variously changed from the designed ejection time to form the forward path line and the backward path line. In FIG. 12, the ejection time of the forward path and the backward path is adjusted from the designed ejection time with the cockling adjustment values r1 to r5 that are candidates, and the forward path line and the backward path line are printed at the ridge portions of the medium. In FIG. 12, after the forward path line is formed at a certain ejecting time, the backward path line is formed at the same ejecting time without transporting the medium. In such a manner, the printing is performed such that the forward path line is partially overlapped with the backward path line.

In the embodiment, as shown in FIG. 11, the cockling adjustment value R is changed according to two kinds of ink duty ranges. For this reason, the pattern is printed on the medium S on which the cockling phenomenon occurring when the ink duty is 50% or higher and lower than 80% is reproduced, and on the medium S on which the cockling phenomenon occurring when the ink duty is 80% or higher is reproduced. Even when the cockling phenomenon occurs on the medium S according to the ink duty, there is a case where some deviation occurs in the paper gap PG. Thus, as the pattern shown in FIG. 12, it is possible to calculate the cockling adjustment value with higher precision by printing the forward path line and the backward path line on the ridge portions of the medium S supported by the plurality of convex portions 1 to 4.

The tester confirms the pattern (FIG. 12) printed in such a manner with the naked eye. The tester determines the adjustment value from the candidate cockling adjustment values r1 to r5, in which the forward path line and the backward path line do not deviate in the movement direction at the ridge portions of the medium. In the pattern result shown in FIG. 12, there is no deviation in the movement direction of the forward path line and the backward path line formed with the cockling adjustment value "r2", and the tester can determine "r2" as the optimal cockling adjustment value. In such a manner, the tester determines the cockling adjustment value R1 for arranging the dot formation positions of the forward path and the backward path of the reference row (K1 row) at the ridge portions of the medium S (S002 of FIG. 10).

In the embodiment, as shown in FIG. 11, the cockling adjustment value R1 of the K1 row is determined for each ink duty. In the embodiment, the ejection time of both of the forward path and the backward path is adjusted from the designed ejection time, and a cockling adjustment value R1*t* of the forward path and the a cockling adjustment value R1*b* of the backward path are determined as shown in FIG. 11. However, the invention is not limited thereto, and the ejection time of one of the forward path and the backward path may be adjusted. In the embodiment, the cockling adjustment value R is the value adjusted from the designed ejection time, but the invention is not limited thereto, and the cockling adjustment value R may be a value adjusted from the ejection time adjusted with the Bid adjustment value. In this case, when the pattern shown in FIG. 12 is printed, the printing is performed at the ejection time obtained by further adjusting the ejection time adjusted with the Bid adjustment value. In this case, in the actual printing, the designed ejection time is adjusted using both of the Bid adjustment value and the cockling adjustment value R, with the candidate cockling adjustment values r1 to r5.

In the pattern shown in FIG. 12, the designed ejection time is variously adjusted by the ejecting times r1 to r5 that are candidates, and the forward path line and the backward path line are actually formed, but the invention is not limited thereto. For example, the forward path line and the backward path line may be formed at the designed ejection time at the ridge portions of the medium S on which the cockling phenomenon is reproduced according to the ink duty. On the basis of the amount of deviation in the movement direction of the forward path line and the backward path line printed in such a manner, the ejection time, when the amount of deviation is zero, of the forward path line and the backward path line may be calculated. The cockling adjustment value R may be calculated on the basis of the difference between the ejection time calculated in such a manner and the designed ejection time.

The cockling adjustment value R corresponds to a value indicating a difference (time) between the designed ink ejection time from the nozzles and the time when actually ejecting ink from the nozzles. Specifically, the cockling adjustment value R is a value indicating "the number of pixels". To print an image on the medium S, pixels are virtually determined on the medium S, and the image is presented on the medium S according to whether or not dots are formed at the pixels. The printer 1 prints the image on the medium S on the basis of printing data indicating whether or not dots are formed at the pixels. For this reason, the printing data corresponding to the pixels are shifted in the movement direction for a pixel unit, and thus the dot formation positions can be shifted in the movement direction. Therefore, when the printing data corresponding to the pixels are shifted, the ink ejection time is adjusted, and the cockling adjustment value corresponds to "the number of pixels" when the dot formation positions are shifted in the movement direction.

However, the invention is not limited thereto. To eject ink from the nozzles, it is preferable to apply a driving wave form to a driving element (e.g., piezoelectric element) corresponding to the nozzles. To put the dot formation positions aside, (to adjust the ink ejection time) the time of applying the driving waveform to the driving element may be adjusted. In this case, specifically, the cockling adjustment value R is a value indicating "a difference (time) between the application timing of the designed driving waveform and the timing of actually applying the driving waveform".

Figure 13:
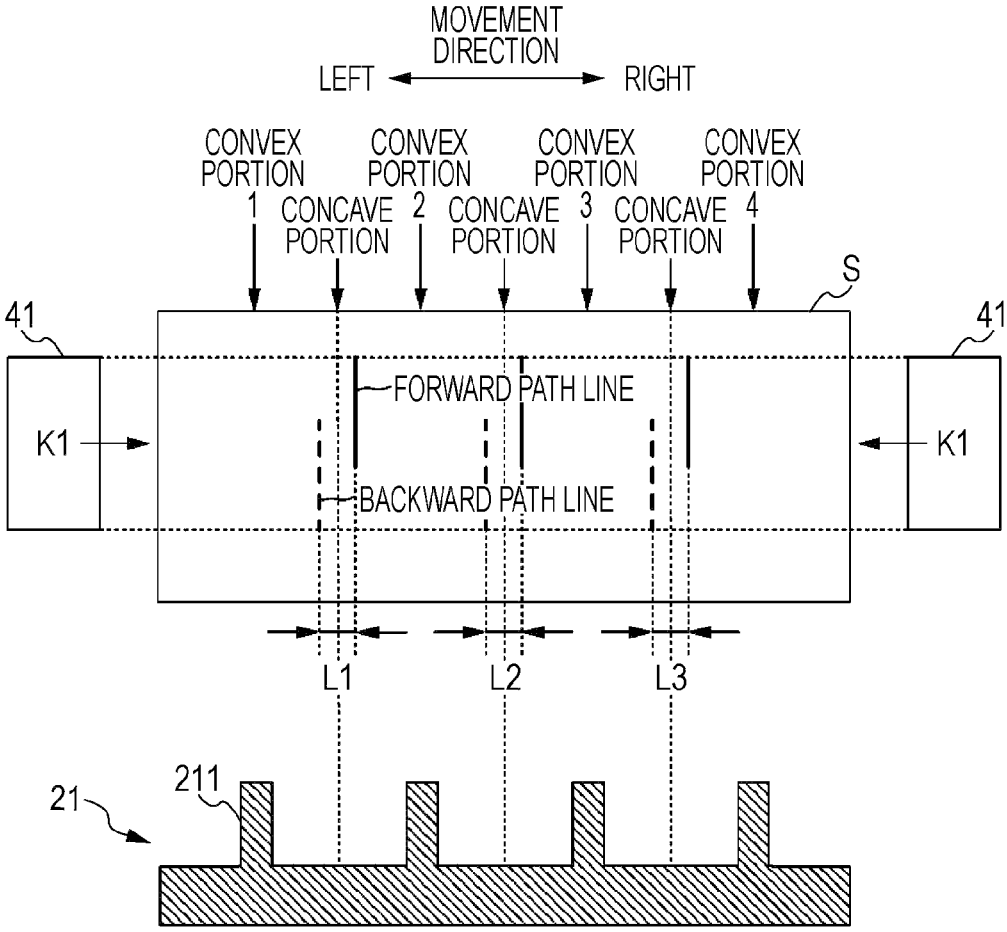
FIG. 13 is a diagram illustrating a pattern of calculating the forward and backward landing position misalignment of a reference position in a valley portion of a medium.

FIG. 13 is a diagram illustrating a pattern of calculating forward and backward landing position deviations L of the reference row (K1 row) at the valley portions of the medium S. After calculating the cockling adjustment value R1 of the reference row (K1 row), the tester caused the printer 1 (K1 row) to form the forward path line and the backward path line (S003 of FIG. 10) at the valley portions of the medium S (the medium positioned at the concave portions) at the ejecting time adjusted with the determined cockling adjustment value R1. Since the cockling adjustment value R1 of the K1 row is set such that the dot formation positions of the forward path and the backward path at the ridge portions of the medium S coincide with each other, the forward path line and the backward path line deviate in the movement direction at the valley portions of the medium S as shown in FIG. 13. The tester calculates the amount of deviation "L" in the movement direction of the forward path line and the backward path line on the basis of the printed pattern result (S004). The amount of deviation L is calculated for each of two kinds of media on which the cockling phenomenon is reproduced according to the ink duty.

Since the plurality of convex portions 211 of the platen 21 are arranged in the movement direction, there is a plurality of valley portions of the medium S. Thus, as shown in FIG. 13, it is preferable to form the forward path line and the backward path line with respect to the plurality of valley portions of the medium S. In such a manner, the plurality of amounts of the deviations (L1 to L3) in the movement direction of the forward path line and the backward path line are calculated, and it is preferable that an average value of the plurality of amounts of the deviations is the amount of deviation L of the forward path line and the backward path line of the K1 row at the valley portions of the medium S. Thereafter, the cockling adjustment value R2 of the K row is calculated on the basis of "amount of deviation L". For this reason, the forward path lines and the backward path lines are formed at the plurality of valley portions of the medium S, the average value of the plurality of amounts of the deviations (L1 to L3) is calculated, and thus it is possible to calculate the cockling adjustment value R2 of the K2 row with higher precision.

The tester calculates the cockling adjustment value R2 of the K2 row such that the dot formation position of the K2 row that is the adjustment row is positioned on the front side (the opposite side to the head movement direction) by a distance "L/2" with respect to the dot formation position of the K1 row that is the reference row (S005). That is, the dot formation position of the K2 row is positioned on the front side with respect to the dot formation position of the K1 row by a half of the length "L/2" of the amount of deviation L of the forward and backward dot formation positions of the K1 row at the valley portions of the medium S.

As shown in FIG. 8, at the valley portions of the medium S, the dots of the forward path of the K1 row are positioned on the right side in the movement direction by the distance L with respect to the dots of the backward path of the K1 row. In the adjustment method of the embodiment, the dot formation position of the K1 row and the dot formation position of the K2 row are shifted, the dots (•) of the K2 row are positioned between the dots (o) of the forward path and the dots (o) of the backward path of the K1 row at the valley portions of the medium S, and thus the joint of the forward path line and the backward path line is made hardly visible. Accordingly, since the dots of the K2 row are positioned between the dots of the forward path and the backward path of the K1 row, the joint of the forward path line and the backward path line can be further made hardly visible.

The dots (•) of the K2 row are shifted by "L/2" with respect to the dots (o) of the K1 row, and thus the forward and backward dot formation positions in the movement direction of the K2 row can be arranged at the valley portions of the medium S. In such a manner, at the valley portions of the medium S, the dots of the forward path and the dots of the backward path of the K1 row deviate most in the movement direction, but the dots of the K2 row are arranged in a straight line in the transport direction. Accordingly, the joint of the forward path line and the backward path line can be hardly visible.

The tester causes the printer 1 to print a pattern (not shown) to calculate the cockling adjustment value R2 for positioning the dot formation position of the K2 row on the front side (the opposite side to the head movement direction) by the distance "L/2" with respect to the dot formation position of the K1 row. For example, it is preferable that the ejection time of the K1 row is adjusted with the cockling adjustment value R1, the ejection time of the K2 row is variously changed, the line of the K1 row (the forward path or the backward path) is formed and the line of the K2 row (the forward path or the backward path) is formed. The medium S printing the pattern may be the medium S on which the cockling phenomenon is reproduced and the other medium on which the cockling phenomenon is not reproduced. The tester determines the ejection time when the line of the K2 row deviates at the position on the front side (the side opposite to the side where the head moves) in the movement direction by the distance "L/2" with respect to the line of the K1 row. A value corresponding to a difference between the determined ejecting time of the K2 row and the designed ejection time of the K2 row is calculated as the cockling adjustment value R2. The cockling adjustment values R2 of the K2 row corresponding to two cockling adjustment values R1 of the K1 row according to the ink duty is calculated. In such a manner, the cockling adjustment values R1 and R2 calculated in the mass-production process are stored in the memories 13 of the printers 1, and then the printers 1 are shipped.

Herein, the dot formation position of the K2 row is shifted by the distance "L/2" at the position opposite to the side where the head 41 moves with respect to the dot formation position of the K1 row, but the invention is not limited thereto. When the dot formation positions of the forward path and the backward path of the K1 row are aligned at the ridge portions, the amount of deviation L of the dot formation positions of the forward path and the backward path of the K1 row is largest at the valley portions of the medium S. For this reason, it is preferable that the dot formation position of the K2 row is shifted at the position opposite to the side the head 41 moves by at least a length of L or less with respect to the dot formation position of the K1 row. In such a manner, at the valley portions of the medium S, the dots of the K2 row can be positioned between the dots of the K1 row of the forward path and the dots of the K1 row of the backward path, and the joint of the forward path line and the backward path line can be made hardly visible.

Modified Example

In the adjustment example (FIG. 8 and FIG. 9) described above about the cockling phenomenon, at the ridge portions or the valley portions of the medium, the ejection time of the reference row is adjusted such that the dot formation positions of the forward path and the backward path of the reference row (K1 row) coincide with each other, that is, the forward path line and the backward path line are aligned along the straight line in the transport direction, but the invention is not limited thereto. At the ridge portions or the valley portions of the medium, it is preferable to adjust the ejection time of the reference row such that the amount of deviation in the movement direction of the dots of the forward path and the backward path of the reference row is less than the amount of deviation in the movement direction of the dots of the forward path and the backward path of the adjustment row (K2 row). For example, when the ejection time is adjusted such that the amount of deviation of the forward and backward dot formation positions of the reference row is small at the ridge portions of the medium, on the contrary, the amount of deviation of the forward and backward dot formation positions of the adjustment row can be made small at the valley portions of the medium. Accordingly, the boundary line of the forward path image and the backward path image can be made hardly visible, without depending on the position of the medium. However, at the valley portions or the ridge portions of the medium, the amount of deviation of the forward and backward dot formation positions of one row of the reference row and the adjustment row is largest. For this reason, it is preferable to align the forward and backward dot formation positions of the reference row in one of the valley portion and the ridge portions of the medium.

FIG. 14 is a diagram illustrating a table in which the cockling adjustment values R according to the kind of the medium are stored. Various media are used for printing according to the user. Even at the same ink duty, the method of occurrence of the cockling phenomenon is different according to the kind of the medium, and the paper gap PG is different. For example, in a medium easily absorbing a solvent component (e.g., water) such as normal paper, the cockling phenomenon easily occurs. In a medium with a thickness similar to that of glossy paper which is hardly deformed, the cockling phenomenon hardly occurs. As described above, even at the same ink duty, it is preferable that the cockling adjustment value is different when the method of occurrence of the cockling phenomenon is different. For this reason, it is preferable that the pattern (FIG. 12 or FIG. 13) is printed on the plurality kinds of media, and the cockling adjustment value R according to the kind of the medium is calculated.

In the embodiment, when the cockling phenomenon does not occur (when the ink duty is lower than 50%), the dot formation positions of the reference row (K1 row) and the adjustment row (K2 row) are arranged, but the invention is not limited thereto. Even when the cockling phenomenon does not occur, the dot formation position of the adjustment row (K2 row) may be shifted in the movement direction with respect to the dot formation position of the reference row (K1 row) similarly to the case where the cockling phenomenon occurs.

Printing Example

Printing Example 1

When the printer 1 receives a printing instruction and printing data from a printer driver installed in the computer 60, the controller 10 (control unit) of the printer 1 determines whether or not two-direction printing is set. When the two-direction printing is performed and the cockling phenomenon occurs on the medium S, the dots are formed as shown in FIG. 8 or FIG. 9 using the cockling adjustment value R (the adjustment process is performed). For this reason, the controller 10 calculates the "maximum ink duty" of the image printed on the medium S on the basis of the printing data. When the maximum ink duty is lower than 50%, only the Bid adjustment value is used without using the cockling adjustment value R. Meanwhile, when the maximum ink duty is 50% or higher, the cockling adjustment value R according to the maximum ink duty is used.

The ink duty is calculated for each color of ink (YMCK), the ink ejection time may be adjusted for each nozzle row, and the ink ejection time may be adjusted on the basis of the maximum value in the ink duty of each ink. The invention is not limited to the "maximum ink duty" of the image printed on the medium S, and the cockling adjustment value R may be determined by determining whether or not the cockling phenomenon occurs on the medium S on the basis of the average ink duty.

As described above, when it is determined whether or not to use the cockling adjustment value on the basis of the ink duty (the maximum value or the average value) in the whole image printed on the medium S, the printing control is relatively easy. However, there is a case where the cockling phenomenon does not occur according to the position of the medium S. However, the paper gap (i.e., the designed paper gap PG) when the cockling phenomenon does not occur becomes a value between the paper gap (PG1 in FIG. 8) of the ridge portion of the medium S and the paper gap (PG3 in FIG. 8) of the intermediate portion of the medium S. Accordingly, even when the image is printed using the cockling adjustment value R with respect to the medium S on which the cockling phenomenon does not occur, the forward path image (line) and the backward path image (line) do not deviate in the movement direction for the ridge portion and the valley portion of the medium S, dissatisfactory of the joint of the forward path image and the backward path image is reduced, and thus there is no problem.

Printing Example 2

In Printing Example 2, the controller 10 calculates the ink duty (the maximum value or the average value) for each image printed in each pass, and determines whether or not to use the cockling adjustment R in the pass. In such a manner, for example, even on the same medium, the image is printed using the Bid adjustment value without using the cockling adjustment R in the medium area where an image (text image) of a low ink duty is printed, and an image is printed using the cockling adjustment value R in the medium area where an image of a high ink duty is printed. As a result, in the image of the low ink duty, the dot formation positions of two nozzle rows (e.g., K1 and K2) ejecting the same color of ink do not deviate in the movement direction. In addition, in the image of the high ink duty, it is possible to reduce the dissatisfactory of the joint of the forward path image and the backward path image even when the cockling phenomenon occurs.

Printing Example 3

In the example described in FIG. 6, when the lines along the transport direction are formed on the forward path and the backward path with respect to the medium S on which the cockling phenomenon occurs, the forward path line and the backward path line deviate in the movement direction, and the image quality of the printed image deteriorates. As described above, when the lines along the transport direction are formed on the forward path line and the backward path line, particularly, the boundary line of the forward path line and the backward path line is easily visible, and the image quality of the printed image deteriorates. Thus, in Printing Example 3, only when the lines along the transport direction are formed on the forward path and the backward path with respect to the medium S on which the cockling phenomenon occurs, the ink ejection time is adjusted using the cockling adjustment value R.

For this reason, the controller 10 of the printer 1 determines whether or not data for printing the line along the transport direction on the forward path and the backward path is within the received printing data. When there is data for printing the line along the transport direction on the forward path and the backward path, the controller 10 determines whether or not the line is printed in the medium area on which the cockling phenomenon occurs. For example, it is determined whether or not the line is formed on the image with the ink duty of 50% or higher or around the image with the ink duty of 50% or higher. When the line is printed in the medium area on which the cockling phenomenon occurs, the controller 10 prints the line at the ejecting time adjusted with the cockling adjustment value R.

Other Embodiments

In the embodiments, the printing system having the ink jet printer has been mainly described, but the invention includes disclosure such as the method of suppressing the deviation of the dot formation positions. The embodiments are to make the invention easily understood, and are not to restrictively analyze the invention. The invention can be modified and improved within the concept thereof, and obviously includes equivalent materials thereof. Particularly, the invention includes the following embodiments.

Background Image

In the embodiments, the printer ejecting three colors of ink YMC and the black ink K is exemplified, but the invention is not limited thereto. There is a printer ejecting white ink W in addition to such ink (YMCK). In such a printer 1, there is a case where a monochromatic image or a color image is repeatedly printed on the background image formed by the white ink to improve the chromatic property of the image. When such printing is performed, it is assumed that the cockling phenomenon occurs on the medium S by printing the background image. Accordingly, the ink ejection time may be adjusted using the cockling adjustment value R to print the color image or the monochromatic image without determining the ink duty.

Arrangement of Nozzles

In the embodiments, as shown in FIG. 2, two nozzle rows (e.g., K1 and K2) ejecting the same color of ink are arranged to deviate by the distance equal to or less than the nozzle pitch in the transport direction, but the invention is not limited thereto. The positions of two nozzle rows ejecting the same color of ink in the transport direction may be the same. In such a printer, for example, a printing method of alternately forming dots in the movement direction by one nozzle row K1 and the other nozzle row K2 and alternately forming dots in the transport direction by one nozzle row K1 and the other nozzle K2 may be performed. Even in this case, it is preferable to adjust the dot formation positions as shown in FIG. 8 or FIG. 9 when the cockling phenomenon occurs on the medium.

Cockling Adjustment Value R

In the embodiments, the cockling adjustment value R varies according to the ink duty or the kind of the medium, but the invention is not limited thereto. For example, there is a case where the method of occurrence of the cockling phenomenon may also vary according to the kind of ink ejected onto the medium. For this reason, the cockling adjustment value R may vary according to the kind of the ink.

Printer

In the embodiments, the printer repeating the operation of forming the image on one paper surface while moving the head in the movement direction and the operation of transporting the paper in the transport direction crossing the movement direction with respect to the head is exemplified, but the invention is not limited thereto. For example, there may be a printer repeating an operation of forming an image while moving a head unit having (a plurality of) heads in the medium transport direction and an operation of moving the head unit in the paper width direction to form an image on continuous paper sheets transported to the printing area, and transporting the part of the medium which has been not printed yet to the printing area.

Fluid Ejecting Apparatus

In the embodiments, the ink jet printer has been exemplified as the fluid ejecting apparatus, but the invention is not limited thereto. The fluid ejecting apparatus can be applied to various industrial apparatuses other than printer (printing device). For example, the invention can be applied to a printing apparatus for attaching a pattern to cloth, a display producing apparatus such as a color filter producing apparatus and an organic EL display, and a DNA chip producing apparatus for producing a DNA chip by applying a solution with dissolved DNA to the chip.

The entire disclosure of Japanese Patent Application No. 2010-009398, filed Jan. 19, 2010 is expressly incorporated by reference herein.

What is claimed is:

1. A fluid ejecting apparatus comprising:

a head that is provided with a first nozzle row in which nozzles ejecting fluid are arranged in a predetermined direction, and a second nozzle row in which nozzles ejecting the fluid are arranged in the predetermined direction, the first nozzle row and the second nozzle row being arranged in a movement direction crossing the predetermined direction;

a platen that supports a medium opposed to the head and is provided with a plurality of convex portions arranged in the movement direction on the side opposed to the medium; and a control unit that repeatedly performs an ejection operation of ejecting fluid from the nozzles moving in two directions of a forward path and a backward path while moving the head forward and backward and an operation of relatively moving relative positions of the head and the medium in one direction of the predetermined direction, wherein the control unit performs an adjustment process of adjusting an ejection time for the fluid from the first nozzle row and the second nozzle row such that, at parts of the medium corresponding to the convex portions, an amount of deviation in the movement direction of the dots formed on the forward path by the first nozzle row and the dots formed on the backward path by the first nozzle row is less than an amount of deviation in the movement direction of the dots formed on the forward path by the second nozzle row and the dots formed on the backward path by the second nozzle row, and such that, in the ejection operation, the position in the movement direction of the dots formed by the second nozzle row is a position opposite to the side on which the head moves in the movement direction with respect to the position in the movement direction of the dots formed by the first nozzle row.

2. The fluid ejecting apparatus according to claim 1, wherein in the ejection operation, a difference between the position in the movement direction of the dots formed by the first nozzle row and the position in the movement direction of the dots formed by the second nozzle row is approximately one half of the amount of deviation in the movement direction of the dots formed on the forward path and the backward path by the first nozzle row at a portion of the medium positioned between the convex portions arranged in the movement direction.

3. The fluid ejecting apparatus according to claim 1, wherein at the parts of the medium corresponding to the convex portions, the ejection time for the fluid from the first nozzle row is adjusted such that the positions in the movement direction of the dots formed on the forward path and the backward path by the first nozzle row coincide with each other.

4. The fluid ejecting apparatus according to claim 1, wherein the ejection time for the fluid from the first nozzle row is an average value of the ejection time of the first nozzle row adjusted such that the amount of deviation in the movement direction of the dots formed on the forward path and the backward path by the first nozzle row is less than the amount of deviation in the movement direction of the dots formed on the forward path and the backward path by the second nozzle row, at the parts of the medium corresponding to the plurality of convex portions.

5. The fluid ejecting apparatus according to claim 1, wherein the control unit performs the adjustment process when the amount of the fluid ejected onto the a vicinity of a unit area on the medium is equal to or more than a threshold value.

6. The fluid ejecting apparatus according to claim 1, wherein the control unit changes the ejection time for the fluid from the first nozzle row and the second nozzle row in the adjustment process, according to an amount of the fluid ejected onto a vicinity of a unit area on the medium.

7. The fluid ejecting apparatus according to claim 1, wherein the fluid ejected from the first nozzle row and the second nozzle row is ink and the color of the ink ejected by the first nozzle row is the same as the color of the ink ejected by the second nozzle row.

8. A fluid ejecting apparatus comprising:

a head that is provided with a first nozzle row in which nozzles ejecting fluid are arranged in a predetermined direction, and a second nozzle row in which nozzles ejecting the fluid are arranged in the predetermined direction, the first nozzle row and the second nozzle row being arranged in a movement direction crossing the predetermined direction;

a platen that supports a medium opposed to the head and is provided with a plurality of convex portions arranged in the movement direction on the side opposed to the medium; and a control unit that repeatedly performs an ejection operation of ejecting fluid from the nozzles moving in two directions of a forward path and a backward path while moving the head forward and backward and an operation of relatively moving relative positions of the head and the medium in one direction of the predetermined direction, wherein the control unit adjusts an ejection time for the fluid from the first nozzle row and the second nozzle row such that, at parts of the medium corresponding to valley portions extending between the convex portions arranged in the movement direction, an amount of deviation in the movement direction of the dots formed on the forward path by the first nozzle row and the dots formed on the backward path by the first nozzle row is less than an amount of deviation in the movement direction of the dots formed on the forward path by the second nozzle row and the dots formed on the backward path by the second nozzle row, and such that, in the ejection operation, the position in the movement direction of the dots formed by the second nozzle row is a position of the side on which the head moves in the movement direction with respect to the position in the movement direction of the dots formed by the first nozzle row.

9. The fluid ejecting apparatus according to claim 8, wherein the fluid ejected from the first nozzle row and the second nozzle row is ink and the color of the ink ejected by the first nozzle row is the same as the color of the ink ejected by the second nozzle row.

10. A fluid ejecting method of a fluid ejecting apparatus including a head that is provided with a first nozzle row in which nozzles ejecting fluid are arranged in a predetermined direction, and a second nozzle row in which nozzles ejecting the fluid are arranged in the predetermined direction, the first nozzle row and the second nozzle row being arranged in a movement direction crossing the predetermined direction, and a platen that supports a medium opposed to the head and is provided with a plurality of convex portions arranged in the movement direction on the side opposed to the medium, in which an ejection operation of ejecting fluid from the nozzles moving in two directions of a forward path and a backward path while moving the head forward and backward and an operation of relatively moving relative positions of the head and the medium in one direction of the predetermined direction are repeatedly performed, wherein an ejection time for the fluid from the first nozzle row and the second nozzle row is adjusted such that, at parts of the medium corresponding to the convex portions, an amount of deviation in the movement direction of the dots formed on the forward path by the first nozzle row and the dots formed on the backward path by the first nozzle row is less than an amount of deviation in the movement direction of the dots formed on the forward path by the second nozzle row and the dots formed on the backward path by the second nozzle row, and such that, in the ejection operation, the position in the movement direction of the dots formed by the second nozzle row is a position opposite to the side on which the head moves in the movement direction with respect to the position in the movement direction of the dots formed by the first nozzle row.

11. The fluid ejecting method according to claim 10, wherein the fluid ejected from the first nozzle row and the second nozzle row is ink and the color of the ink ejected by the first nozzle row is the same as the color of the ink ejected by the second nozzle row.

* * * * *